US006375440B2

(12) United States Patent
Kosugi

(10) Patent No.: US 6,375,440 B2
(45) **Date of Patent: *Apr. 23, 2002**

(54) FAN UNIT, FAN ASSEMBLY, AND AN APPARATUS COMPRISING THE FAN ASSEMBLY

(75) Inventor: Naofumi Kosugi, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/532,054

(22) Filed: Mar. 21, 2000

(30) Foreign Application Priority Data

Sep. 30, 1999 (JP) ..... 11-280067

(51) Int. Cl.[7] ..... F04B 17/00; F04B 35/04

(52) U.S. Cl. ..... 417/423.14; 165/80.3; 416/247 R

(58) Field of Search ..... 392/365; 454/244, 454/184; 123/41.99; 416/244 R, 247 R; 310/89; 417/360, 423.14, 423.15, 423.1; 165/80.3

(56) References Cited

U.S. PATENT DOCUMENTS

| | | | | | |
|---|---|---|---|---|---|
| 4,642,441 | A | * | 2/1987 | Kenyon | 392/365 |
| 4,773,310 | A | * | 9/1988 | Corwin | 454/244 |
| 4,962,734 | A | * | 10/1990 | Jorgensen | 123/41.49 |
| 5,110,263 | A | * | 5/1992 | Chiu | 416/244 R |
| 5,474,427 | A | * | 12/1995 | Redetzke | 416/247 R |
| 5,616,975 | A | * | 4/1997 | May et al. | 310/89 |
| 5,788,467 | A | * | 8/1998 | Zenitani et al. | 417/360 |
| 6,022,200 | A | * | 2/2000 | Meyers | 417/423.15 |
| 6,042,474 | A | * | 3/2000 | Harvey et al. | 454/184 |
| 6,074,182 | A | * | 6/2000 | Matson | 417/423.15 |
| 6,115,250 | A | * | 9/2000 | Schmitt | 361/695 |
| 6,129,528 | A | * | 10/2000 | Bradbury et al. | 417/423.1 |
| 6,199,624 | B1 | * | 3/2001 | Wotring | 165/80.3 |

FOREIGN PATENT DOCUMENTS

| | | | | |
|---|---|---|---|---|
| GB | 20666362 A | * | 7/1981 | F04D/25/10 |
| JP | 2240621 A | * | 8/1991 | F24F/13/00 |
| JP | 6-29193 | | 4/1994 | |
| JP | 7-7188 | | 1/1995 | |
| JP | 7-42185 | | 7/1995 | |
| JP | 9-199881 | | 7/1997 | |
| JP | 9257358 | * | 10/1997 | F25D/19/00 |
| JP | 1089719 | * | 4/1998 | F24F/1/00 |

* cited by examiner

*Primary Examiner*—Theresa Walberg
(74) *Attorney, Agent, or Firm*—Armstrong, Westerman & Hattori, LLP

(57) ABSTRACT

The fan unit has a fan 150, fan housing frame 110, and fan housing cover 170. The fan 150 has a frame 151, a fan blade 152 freely rotatable to the frame, and a mounting hole 153 disposed to the frame. The box frame 110 has an opening 115 on one (top) side for disposing the fan 150 internally thereto, a ventilation opening in the opposite (bottom) side, and engaging members 117 formed on an inside wall for fitting into a mounting hole 153 of the internally disposed fan and thereby determining the fan position. The cover 170 has a ventilation opening, and an engaging protrusion on an inside wall for fitting into a mounting hole 153 of the fan internally disposed to the fan housing frame. The fan housing cover 170 thus engages the fan housing frame 110 so as to cover the opening 115 into which the fan is installed, and in conjunction with the fan housing frame 110 secures the fan in the fan housing frame.

16 Claims, 32 Drawing Sheets

110
170
124b
S
124
124a
AIR
122
122a
114
120
122b
119
(B)
121
119
120
S
170
110
120
S
170
119
110
X
174
121
116
121
121
(A)
(C)
(D)
121
110
123b
125
170
125a
125b
123a
AIR
123
S
(E)
123a
123b (A)
(B)
(C)
(D)
AIR
S
A
110
111
114
116
117
118
119
120
121
122
122a
122b
124
124a
124b
R1

FAN UNIT, FAN ASSEMBLY, AND AN APPARATUS COMPRISING THE FAN ASSEMBLY

BACKGROUND OF THE INVENTION

1. Field of the Invention

The present invention relates to a fan unit assembled as a single unit, a fan assembly having a fan case for housing the fan unit, and a product comprising this fan assembly.

2. Description of the Related Art

Fans are installed in a wide range of industrial and consumer products for moving air heated by heat sources inside the product to the outside of the product. More and more industrial products operate continuously all the day, and the ability to maintain and replace parts without turning the power off and with the product continuing to operate is desirable. Fans are no exception, and fans which can be replaced while the power supply to the product in which the fan is used remains on are needed. Continuous operation also shortens fan service life, thus increasing the opportunities for fan replacement. It is therefore also necessary to improve the safety and ease with which fans can be replaced.

FIGS. 37 to 39 show a typical fan unit, FIGS. 37 and 38 being perspective views thereof from different directions, and FIG. 39 being an exploded perspective view of the fan unit.

As shown in these figures, the fan unit 900 comprises a fan 910, fan box 920, printed circuit board 930, LED 940, and a plurality of screws 950.

The fan 910 has a frame 911 and a fan blade 912 freely rotatable to the frame 911. A mounting hole 913 is disposed at each of the four corners of the frame 911.

The fan box 920 is typically formed by shaping sheet metal. A finger guard 921 preventing a finger from entering the fan is formed at the ventilation opening in the bottom or side as seen in FIG. 38. A cantilevered beam-shaped operating lever 922 is further disposed to the fan box 920. When the fan unit 900 is housed in a fan case (not shown in the figures), this operating lever 922 prevents unintentional removal of the fan unit 900 from the fan case. It can also be operated so that the fan unit 900 can be removed from the fan case.

A control circuit (not shown in the figures) for controlling rotation of the fan blade 912, and switching the LED 940 on/off, is provided on the printed circuit board 930. Also provided thereon are a connector 931 for connection with the LED 940, and a connector 932 for connection with the fan 910 motor (not shown in the figures). These connectors 931, 932 are connected with the LED 940 and fan 910 (that is, the fan motor) by wiring not shown in the figures. As also shown in FIG. 37, a guard edge 933 protruding to the front of the fan unit when the fan unit 900 is assembled is also formed on this printed circuit board 930. This guard edge 933 is inserted to a connector (not shown in the,figures) coupled to the printed circuit board 930, and transfers power and signals therefrom to the printed circuit board 930.

A plurality of screws 950 of a plurality of types are used to assemble this fan unit 900.

As shown in FIGS. 37 to 39, a conventional fan unit thus comprised has a plurality of fan boxes 920 made from sheet metal, and is assembled using a large number of screws. Assembly is thus inefficient and costly.

The productivity of the process for housing this fan unit 900 into a fan case (not shown in the figures) and connecting a connector to the guard edge 933 of the printed circuit board 930 [920, sic] is also poor. There are also maintenance-related problems.

SUMMARY OF THE INVENTION

With respect to the aforementioned problems, it is therefore an object of the present invention to provide a fan unit that is easy to handle and reduces cost. A further object is to provide a fan assembly whereby fan unit maintenance and replacement are simple. Another object is to provide an apparatus (product) comprising a fan assembly of the present invention.

To achieve this object a fan unit according to the present invention comprises a fan, a fan housing frame, and a fan housing cover. The fan has a frame, a fan blade freely rotatable to the frame, and an installation member disposed to the frame. The fan housing frame has an opening on one side for disposing the fan internally thereto, a ventilation opening in the opposite side, and an engaging member formed on an inside wall for engaging the installation member of the internally disposed fan and thereby determining the fan position. The fan housing cover has a ventilation opening, and an engaging member on an inside wall for engaging the installation member of the fan internally disposed to the fan housing frame. The fan housing cover thus engages the fan housing frame so as to cover the opening into which the fan is installed, and in conjunction with the fan housing frame secures the fan in the fan housing frame.

With a fan unit of the present invention, a fan placed into the fan housing is positioned therein by inserting engaging protrusions (tabs and claws) of the fan housing frame and cover into corresponding holes. No screws are therefore needed to secure the fan in the fan housing. The fan housing cover is similarly engaged with the fan housing frame by means of matching tabs, claws, and holes, and no screws are therefore needed to secure the cover to the box frame.

A fan unit according to the present invention can thus be easily assembled without using any screws or tools such as screwdrivers, and thus helps reduce manufacturing cost.

The present fan unit further preferably has a finger guard formed to the opening of the fan housing frame from which the fan is not inserted (the bottom opening below); and a finger guard formed to the opening in the fan housing cover.

As shown in FIG. 37 to FIG. 39, a fan unit according to the related art only has a finger guard on one side. This makes maintaining or replacing a fan while turning at high speed in the product in which it is used potentially dangerous. Safety can be improved, however, by providing a finger guard on both sides of the fan unit as per the present invention.

Yet further preferably, the fan housing frame and fan housing cover of a fan unit of the present invention are resin moldings.

In addition to helping reduce cost, using resin moldings assures that the box frame and cover are electrically isolated from the power source so that safety can be further improved when maintaining or replacing an operating fan.

The finger guard of a fan unit according to the related art as shown in FIGS. 37 to 39 is made from sheet metal. The finger guard thus provides great resistance to air flow, and is the source of quite loud noise.

However, by molding the finger guard from resin, the finger guard can be shaped to produce little air resistance, and is thus effective as a way to reduce noise.

Yet further preferably, the fan unit comprises a printed circuit board having on one end a card edge for insertion to a connector, and having a control circuit mounted thereon for controlling fan blade rotation. The fan housing frame in this case also has an opening for passing the card edge of a printed circuit board disposed internally to the fan housing frame outside the fan housing to the front in a specific insertion direction orthogonal to the direction of air flow of air moved by the fan. The fan housing frame also has a retainer on an internal wall for holding a side of the printed circuit board disposed internally to the fan housing frame. The fan housing cover in this case further has on an internal wall a retainer for holding the printed circuit board side opposite the side held by the fan housing frame. In conjunction with the fan housing frame, the fan housing cover thus secures a printed circuit board disposed internally to said fan housing frame.

Similarly to a fan unit according to the related art as shown in FIG. 37 to FIG. 39, a printed circuit board is preferably assembled into a fan unit of the present invention. In a fan unit of the present invention, however, the printed circuit board is held securely by the retainers provided on the fan housing frame in which the printed circuit board is installed and the fan housing cover. As a result, the fan unit of the present invention can still be easily assembled without using any screws or tools even when a printed circuit board is installed in the fan unit.

Yet further preferably, the fan housing frame also comprises a cantilevered beam-shaped operating lever extending in the direction opposite to the direction in which the fan unit is inserted to a fan case. This insertion direction intersects the direction of air flow of air moved by the fan. The operating lever has an engaging member for preventing removal of the fan unit from the fan case when the fan unit is installed to the fan case for housing the fan unit. This engaging member is formed in the middle of the operating lever between the front and back ends in the insertion direction.

It should be noted that the provision of this operating lever is the same as in the related art, but providing this operating lever also improves handling the fan unit of the present invention.

Yet further preferably, the fan housing frame of a fan unit according to this invention has a side wall extending in the direction of air flow and the insertion direction with two edges extending in the insertion direction, and a guide channel formed in the exterior side of this side wall. The guide channel has a first channel part extending from one side wall edge into the middle toward the other side wall edge, and a second channel part extending from the end of the first channel part to the back in the insertion direction.

By thus forming a guide channel in the fan unit, the fan unit can be easily installed to and removed from a fan case even when space is confined as further described below. This improves fan unit handling, as well as the ease of fan unit maintenance and replacement.

A fan assembly achieving the above object comprises a fan case for housing a fan unit, and a connector to which connection is made by installing the fan unit to the fan case. More specifically, the fan unit housed in the fan case comprises a fan having a frame and a fan blade freely rotatable to the frame; a printed circuit board having on one end a card edge for connecting by insertion to a connector, and having mounted thereon a control circuit for controlling fan blade rotation; and a fan housing for internally housing the fan, the printed circuit board with the card edge thereof projecting externally to the front in a specific insertion direction intersecting a direction of air flow of air moved by said fan, and having a ventilation opening on both walls in the direction of air flow. The connector is removably fixed to the fan case, and is connected with the card edge of the printed circuit board projecting forward in the insertion direction by the action of installing the fan unit to the fan case.

A fan assembly according to the present invention thus comprises a fan case in which a fan unit is installed, and a connector to which the card edge of a printed circuit board in the fan unit is inserted. The connector is removably fixed to the fan case, and the card edge of the printed circuit board is inserted to the connector by the operation for installing the fan unit to the fan case. Connection to the connector can thus be accomplished by simply installing the fan unit to the fan case, and a fan assembly in which the assembled fan unit can be installed, maintained, and replaced with great simplicity is thus achieved.

Further preferably, the connector of this fan assembly has a body with an opening for inserting the card edge of the printed circuit board, first and second arms projecting to both sides from the body, and an engaging protrusion formed on the first arm. In addition, the fan case has an arm engaging hole for holding the second arm of the connector, which is inserted thereto by sliding the connector in the direction in which the second arm extends, and a slot in which the engaging protrusion of the first arm is inserted. This slot has an inwardly protruding engaging protrusion for engaging the engaging protrusion of the first arm when the second arm is inserted into the arm engaging hole.

Thus comprised, the connector can be easily and reliably installed and removed from the fan case without using any screws or other fasteners, or any tools.

Yet further preferably, the fan unit of this fan assembly comprises a cantilevered beam-shaped operating lever extending in a direction opposite to a specific insertion direction, and a specific engaging member formed on the operating lever between the ends of the operating lever. The fan case further comprises a removal prevention member for preventing fan unit removal by interfering with the engaging member of a fan unit housed internally to the fan case, and allowing fan unit removal when the operating lever is operated to release interference with the engaging member.

Unintentional removal of the fan unit from the fan case can thus be prevented while also allowing for easy installation and removal of the fan unit to and from the fan case as necessary.

Yet further preferably, the fan case of the fan assembly holds a plurality of fan units stacked together in the direction of air flow.

When thus comprised, air flow can be maintained even part of the plurality of fan units fails.

Yet further preferably, the fan unit of the fan assembly comprises a guide channel in an exterior part of a side wall, and the fan case comprises on an inside wall thereof a guide protrusion that fits into the guide channel. This side wall of the fan unit extends in the direction of air flow and the insertion direction, and has two edges extending in the insertion direction. The guide channel has a first channel part extending from one side wall edge into the middle toward the other side wall edge, and a second channel part extending in the direction opposite the insertion direction from the end of the first channel part. The fan unit is installed to the fan case by sliding the fan unit along the first channel part and then sliding it along the second channel part with the guide protrusion fit into the guide channel.

A fan unit thus comprised can be easily installed to and removed from the fan case even in confined spaces.

Further alternatively, the fan unit in a fan assembly according to the present invention comprises a guide channel in an exterior part of a side wall, which extends in the direction of air flow and the insertion direction, and has two edges extending in the insertion direction. The guide channel has a first channel part extending from one side wall edge into the middle toward the other side wall edge, and a second channel part extending in the direction opposite the insertion direction from the end of the first channel part. The fan case in this fan assembly houses a plurality of fan units with at least two arranged in the insertion direction, is freely removably inserted in the insertion direction to a specific apparatus, and comprises a first section in the back in the insertion direction for holding a fan unit, and a second section in the front in the insertion direction for holding a fan unit. This second section has on an inside wall thereof a guide protrusion that fits into the guide channel. A fan unit is installed to this first section by sliding it in the insertion direction. A fan unit is installed to the second section by sliding the fan unit along the first channel part and then sliding the fan unit along the second channel part with the guide protrusion fit into the guide channel.

When it is necessary to move air over a wide area using a plurality of fan units arrayed side by side, a plurality of fan units can be arranged side by side in the direction in which they are inserted to the fan case, and the fan case is then inserted in the same insertion direction to the device in which the fan array is used. By using the design of the present invention for fitting a guide protrusion (pin) into a guide channel and then sliding the fan unit into place in the part of the fan case to the front in the insertion direction, the fan unit installed to this front section can be easily installed and removed as needed.

An apparatus (product) according to the present invention incorporates any one of the fan assemblies of the invention as described above.

By thus incorporating one of these fan assemblies, the apparatus (product) of the invention provides for simple fan maintenance and replacement.

BRIEF DESCRIPTION OF THE DRAWINGS

These and other objects and features of the present invention will be readily understood from the following detailed description taken in conjunction with preferred embodiments thereof with reference to the accompanying drawings, in which like parts are designated by like reference numerals and in which.

DESCRIPTION OF THE PREFERRED EMBODIMENTS

Figure 1:
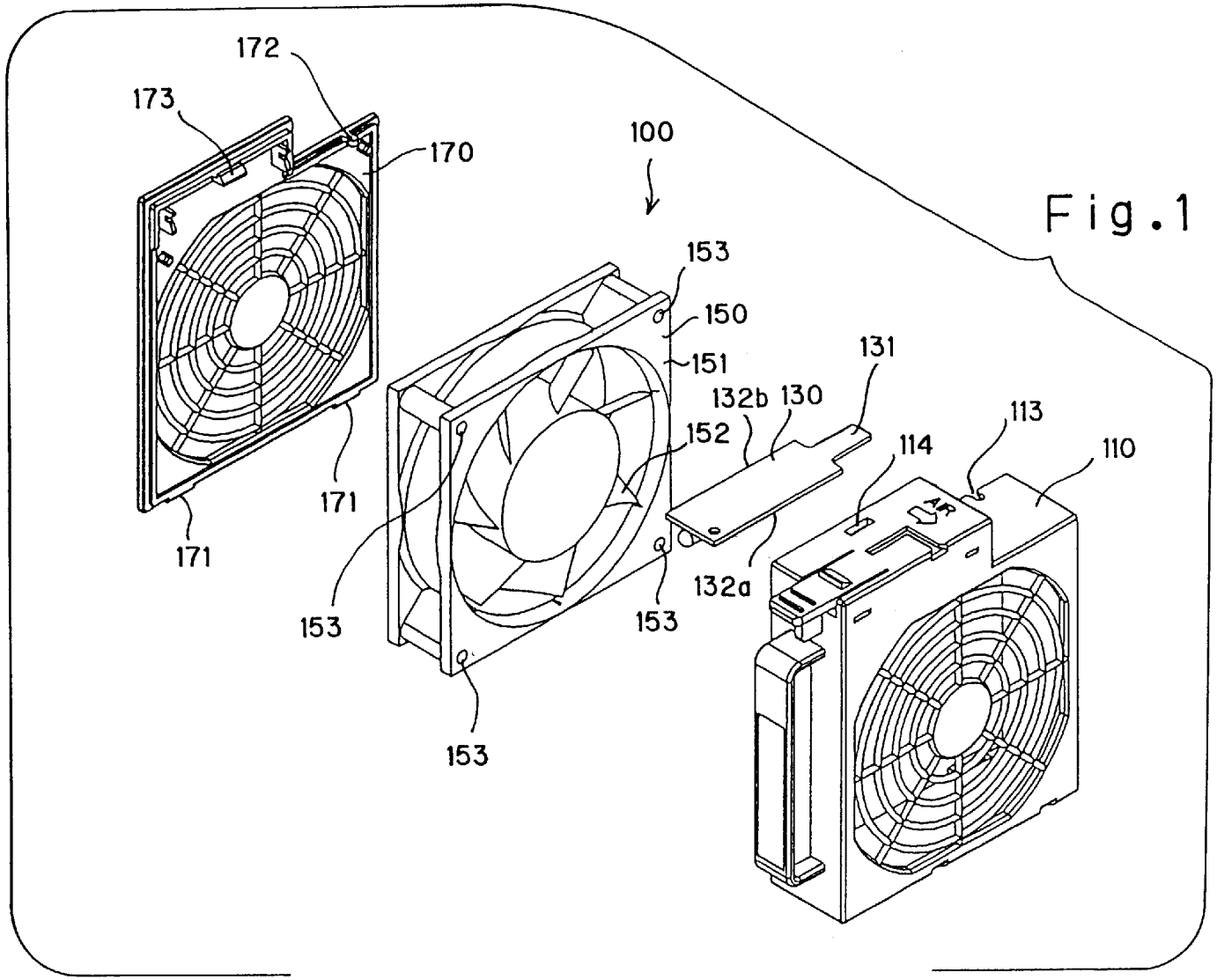
FIG. 1 is an exploded perspective view of a fan unit according to a preferred embodiment of the present invention.
Figure 2:
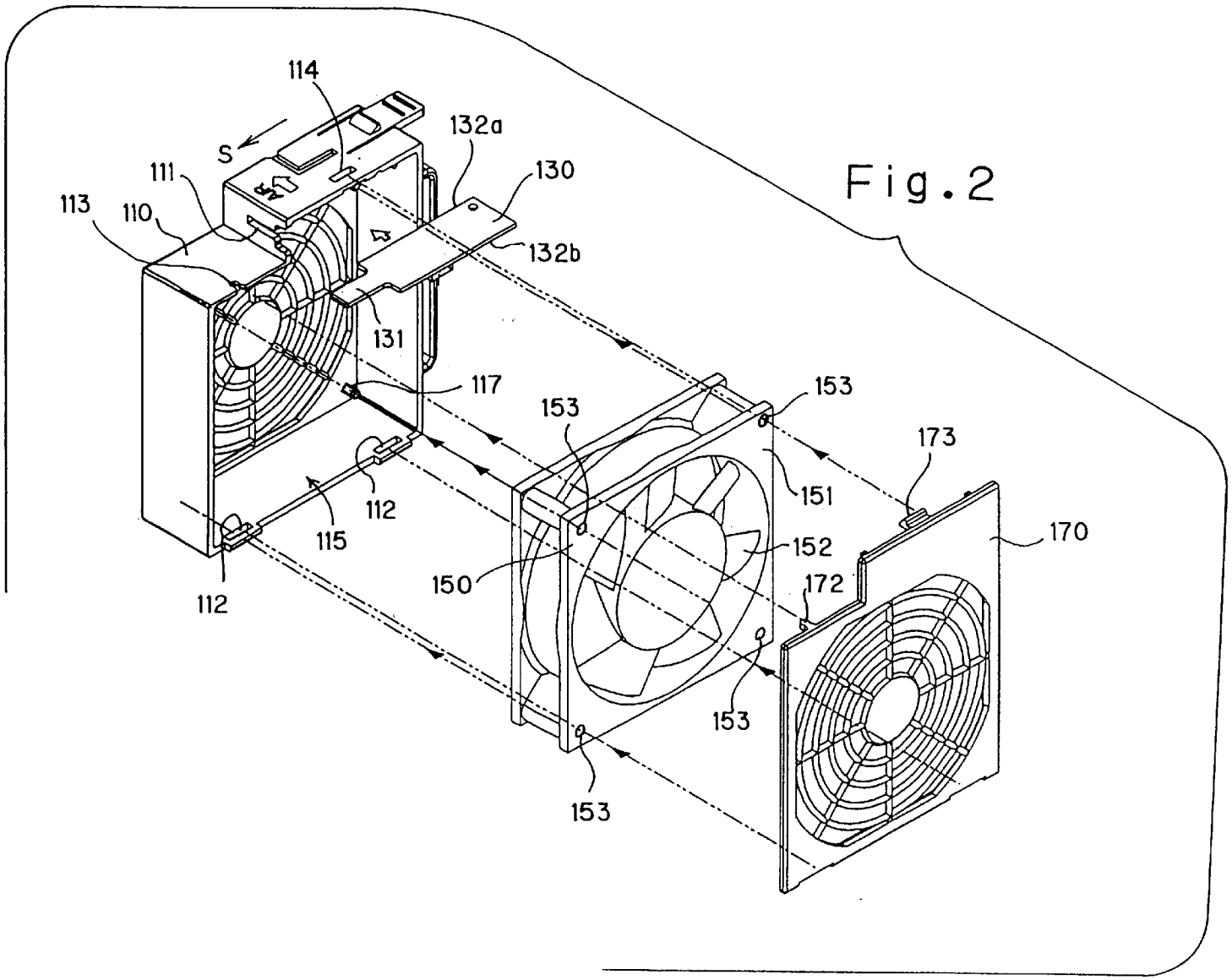
FIG. 2 is an assembly diagram of the fan unit shown in FIG. 1.

The preferred embodiments of the present invention are described below with reference to the accompanying figures. FIG. 1 is an exploded perspective view of a fan unit according to a preferred embodiment of the present invention, and FIG. 2 is an assembly diagram of this fan unit.

As shown in these figures, this fan unit 100 comprises a fan housing frame 110, a printed circuit board 130, fan 150, and fan housing cover 170.

The printed circuit board 130 is housed in the fan housing frame 110 with circuit board card edge 131 protruding forward in a specific insertion direction S from an opening 111 in the box frame 110. The fan 150 is then placed in the box frame 110, and the cover 170 is then fastened to the box frame 110 with the printed circuit board 130 and fan 150 housed thereinside.

Tabs 171 (see FIG. 1) and 172, and claw 173 are formed on the fan housing cover 170. Matching engaging holes 112, recess 113, and hole 114 are formed in the fan housing frame 110. The cover 170 is thus fastened to the box frame 110 by fitting tabs 171 into matching engaging holes 112 in the box frame 110, and then swinging the cover 170 to the box frame 110 as though closing a door with the tabs 171 and holes 112 acting as a hinge so that tab 172 of cover 170,fits into recess 113 of box frame 110, and engaging claw 173 of cover 170 fits into and engages hole 114 in box frame 110. When the fan housing cover 170 is thus secured to the fan housing frame 110, it closes fan housing opening 115 in which the printed circuit board 130 and fan 150 are housed. A fan housing is thus formed by the fan housing frame 110 and fan housing cover 170. The printed circuit board 130 and fan 150 are also secured inside the fan housing as further described below.

It will be noted that absolutely no tools are required to house printed circuit board 130 and fan 150 in fan housing frame 110 and install cover 170 to the box frame 110, and assembly is thus quite simple.

It should be further noted that the cover 170 fastened to the box frame 110 can be removed therefrom by pushing with the tip of a slender tool, such as a flat screwdriver, on the claw 173 [143, sic] fit into hole 114 using a certain degree of force so as to disengage the claw 173 [143, sic] from the hole 114. The cover 170 can then be swung open using the tabs 171 and holes 112 as a hinge, and removed from the box frame 110. However, it is typically not necessary to disassemble the fan unit 100 for maintenance and replacement, and when replaced the fan unit 100 is replaced as a single unit.

The fan housing frame 110 and fan housing cover 170 are both resin moldings in this exemplary embodiment of the invention.

The fan 150 comprises a frame 151, a freely rotatable blade 152, and a motor (not shown in the figures) fixed to the frame for turning the blade 152. The blade 152 is disposed centrally to so that it is surrounded by frame 151 [150, sic]. A mounting hole 153 is formed in each of the four corners of the frame 151 [150, sic]. These holes 153 are exemplary of an installation member of the present invention. The frame 151 and blade 152 of this fan 150 are also resin moldings.

Figure 3:
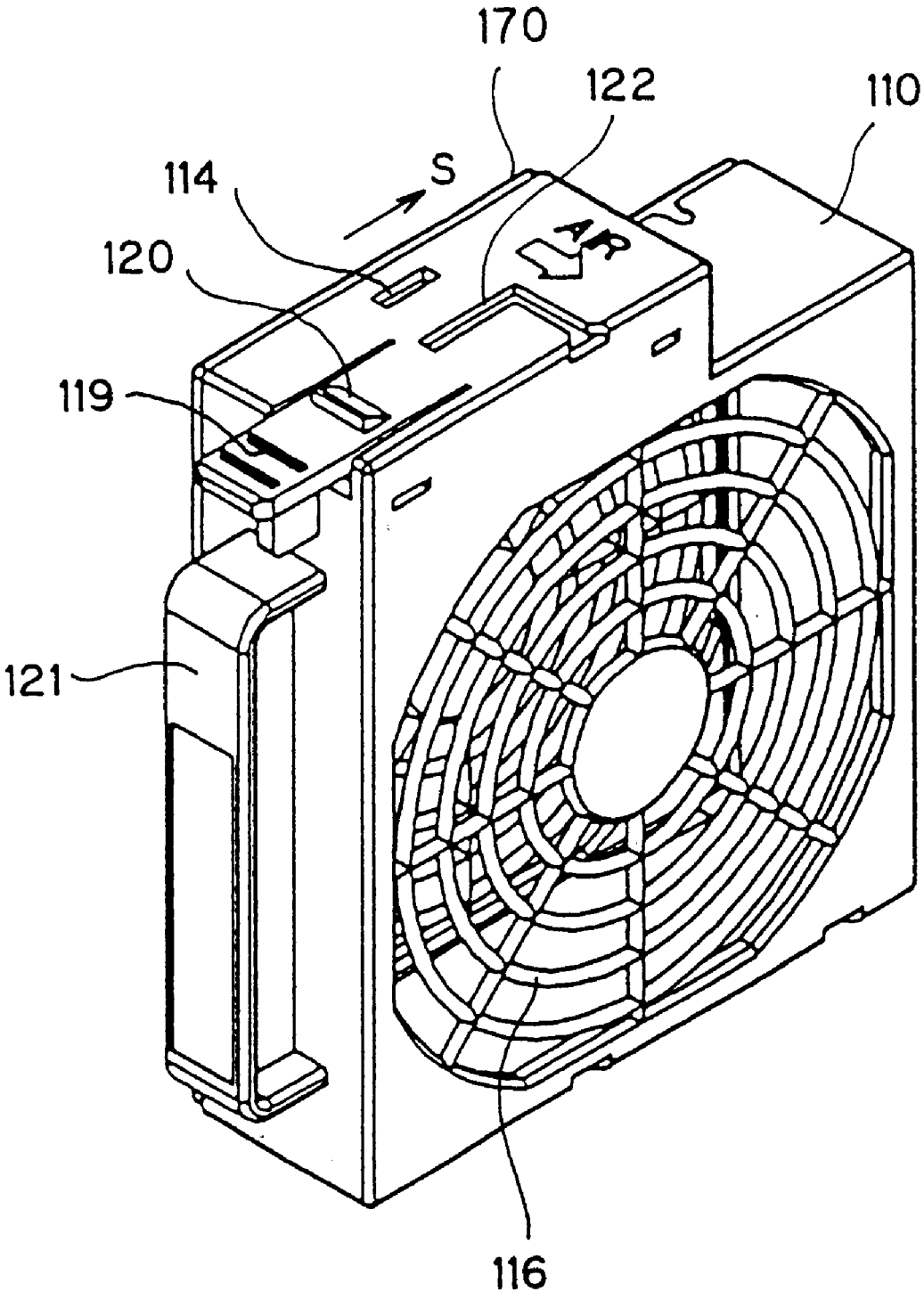
FIG. 3 is a perspective view of a fan housing assembled from the fan housing frame and fan housing cover shown in FIG. 1
Figure 4:
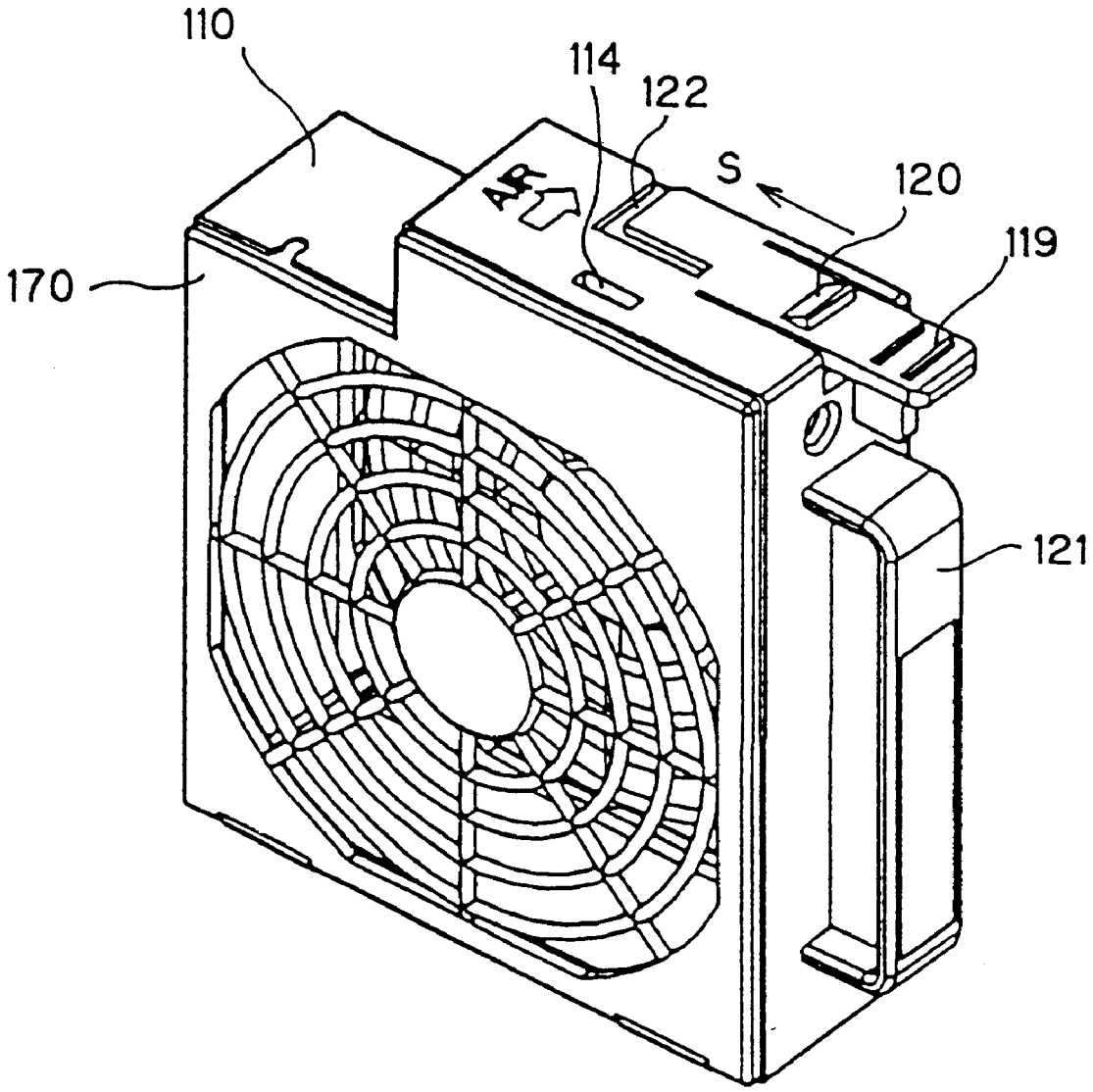
FIG. 4 is a perspective view from a different angle of a fan housing assembled from the fan housing frame and fan housing cover shown in FIG. 1.
Figure 5:
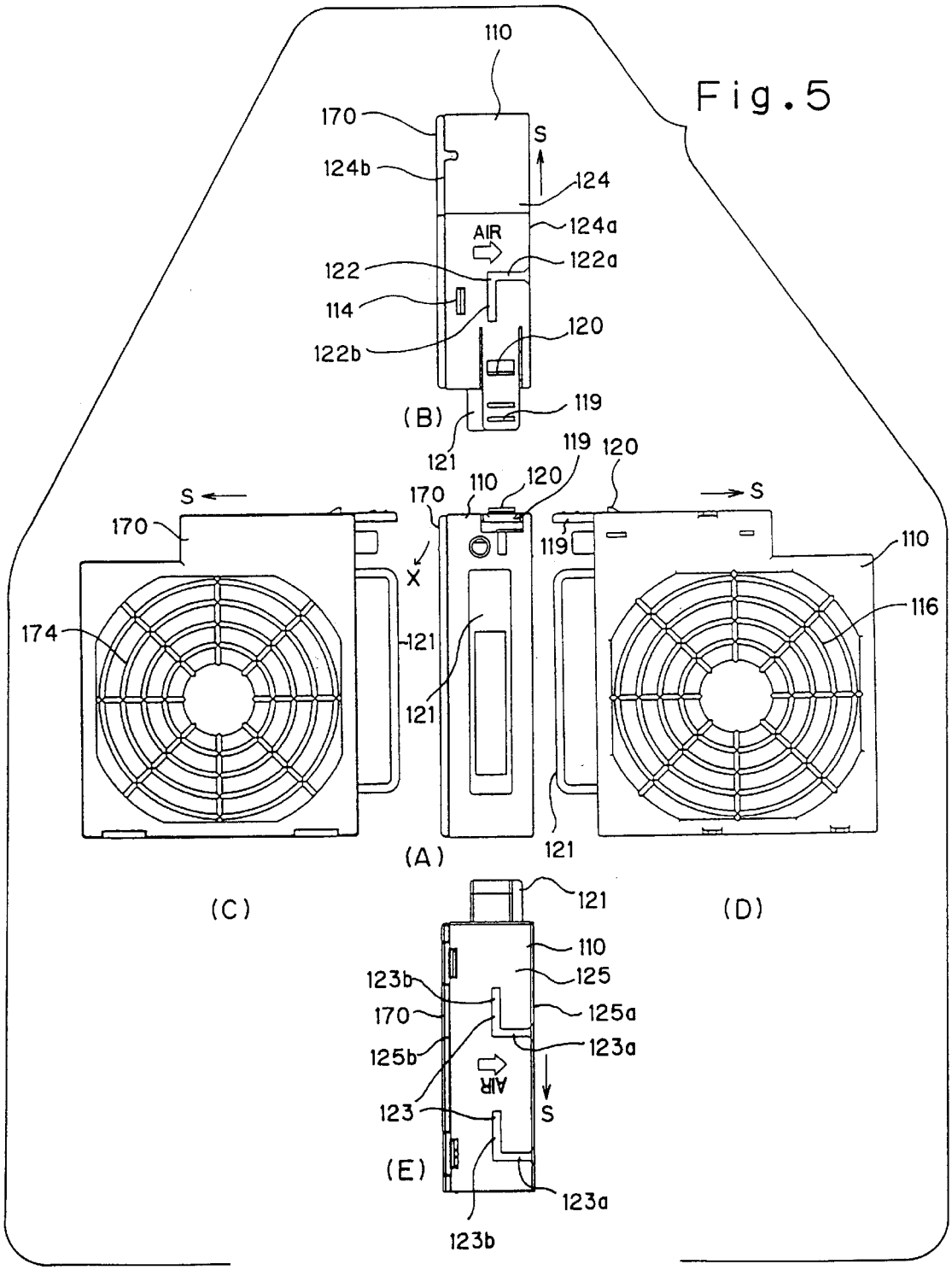
FIG. 5 shows five side views of the fan housing shown in FIG. 3((A) is a front view, (B) is a plan (top) view, (C) is a left side view, (D) is a right side view, and (E) is a bottom view)

FIGS. 3 and 4 are perspective views from different angles of a fan housing assembled from the above-noted fan housing frame 110 and fan housing cover 170. FIG. 5(A) is a front view, (B) is a plan (top) view, (C) is a left side view, (D) is a right side view, and (E) is a bottom view of this fan housing.

Figure 6:
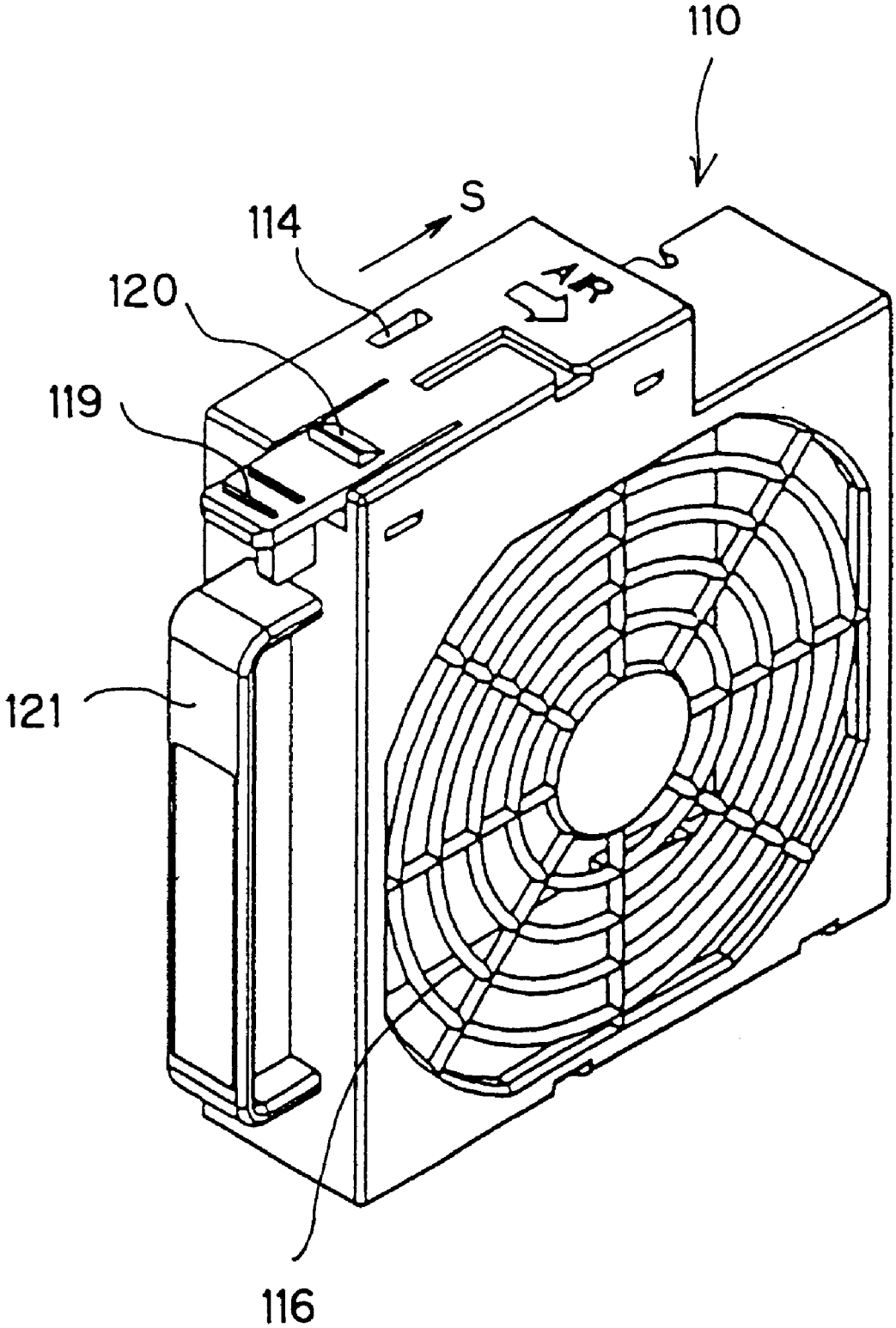
FIG. 6 is a perspective view of the fan housing frame shown in FIG. 1.
Figure 7:
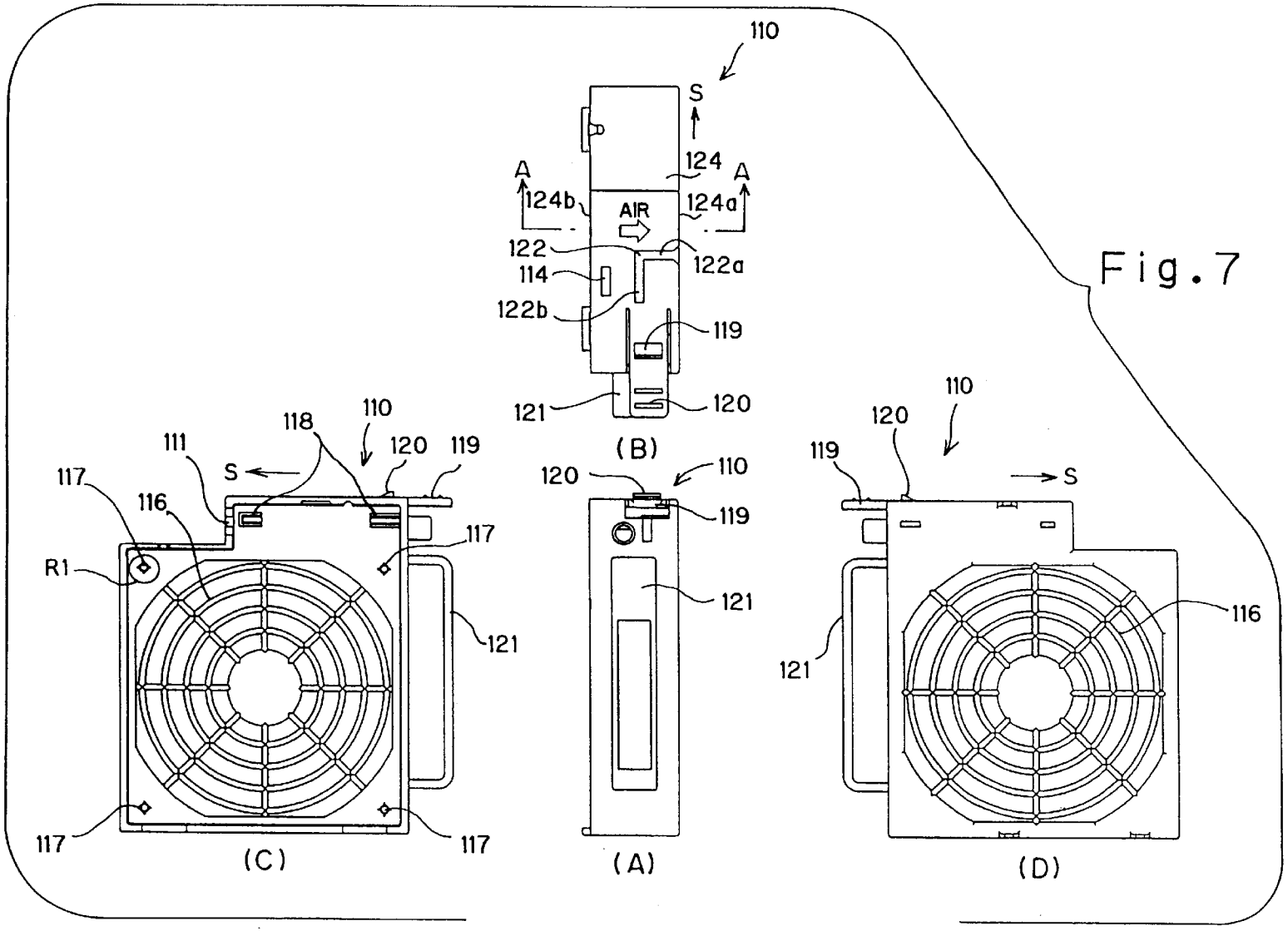
FIG. 7 shows four side views of the fan housing frame shown in FIG. 1.
Figure 8:
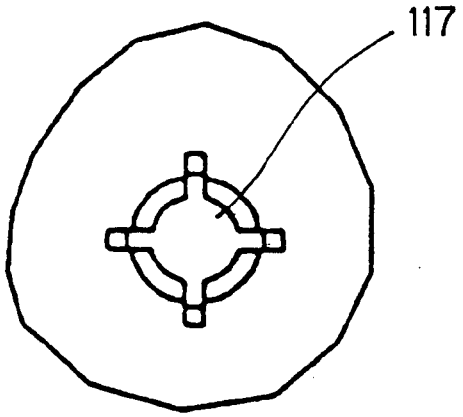
FIG. 8 is an enlarged view of the area inside circle R1 in FIG. 7(C)
Figure 9:
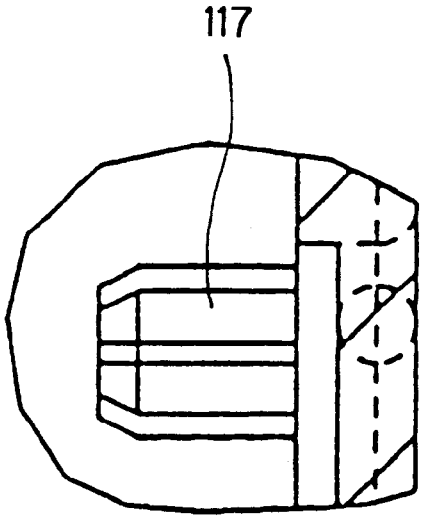
FIG. 9 is an enlarged view of the part shown in FIG. 8 when viewed in section through line A—A in FIG. 7(B)

FIG. 6 is a perspective view of the box frame 110, and FIGS. 7(A) to (D) are front, top, left, and right sides views of the box frame 110. FIG. 8 is an enlarged view of the area inside circle R1 in FIG. 7(C), and FIG. 9 is an enlarged view of the part shown in FIG. 8 when viewed in section through line A—A in FIG. 7(B).

Arrow S shown in some of these figures indicates the insertion direction indicated by arrow S in FIG. 2.

This fan housing frame 110 is described in detail next below with reference to FIGS. 3 to 9.

In addition to opening 115 (see FIG. 2) for housing printed circuit board 130 [120, sic] and fan 150 [130, sic] inside box frame 110, box frame 110 has a ventilation opening further formed in the bottom thereof with a finger guard 116 formed in this ventilation opening. The members of this finger guard 116 are thin as shown in the figure so that resistance to air flow is low and noise is kept low. The four engaging protrusions 117 shaped as shown in an enlarged view in FIG. 8 are formed around the finger guard 116 as shown in FIG. 7 in the bottom wall of the box frame 110. It should be noted that these engaging protrusions 117 are an example of the engaging members of the present invention. When the fan 150 is installed to the box frame 110, these four engaging protrusions 117 are fit into the four mounting holes 153 formed in frame 151 of fan 150 (see FIGS. 1 and 2), and thus function to secure fan 150 inside box frame 110.

A slotted retainer 118 is formed in the bottom inside wall of the box frame 110 where the printed circuit board 130 is located. When the printed circuit board 130 is installed to the box frame 110, one side 132*a* thereof as shown in FIG. 1 and FIG. 2 is fit into this slotted retainer 118 and held with card edge 131 projecting from opening 111 in the insertion direction as indicated by arrow S.

A cantilevered beam-shaped operating lever 119 extending to the back relative to the insertion direction S is formed at an outside wall of the box frame 110. An engaging protrusion 120 for preventing removal of the fan unit 100 from the fan case when the fan unit 100 is installed to a fan case for housing the fan unit 100 is formed at a point between the ends of the operating lever 119. This protrusion 120 is further described in detail below.

A handle 121 is also disposed to this box frame 110 to make it easier to install the fan unit 100 to the fan case and remove it therefrom.

The letters AIR and an arrow are also formed as surface markings in the box frame 110 as shown in the top views in FIG. 5(B) and FIG. 7(B), and the bottom view in FIG. 5(E). The direction indicated by this arrow is the direction in which the fan installed in this fan housing pushes air, that is, the direction of air flow.

As also shown in the top views in FIG. 5(B) and FIG. 7(B), and the bottom view in FIG. 5(E), L-shaped guide channels 122 and 123 are formed to the box frame 110. These L-shaped guide channels 122 and 123 are formed in the outside wall of sides 124 and 125, which are coplanar to the direction of air flow AIR and insertion direction S, of box frame 110. The guide channels 122 and 123 each comprise a first channel part 122*a* and 123*a*, and a second channel part 122*b* and 123*b*. The sides 124 and 125 each have two edges. 124*a*, 124*b* and 125*a*, 125*b* substantially parallel to the insertion direction S. The first channel part 122*a* and 123*a* of guide channels 122 and 123 extends from one edge 124*a*, 125*a* toward the other edge 124*b*, 125*b* to the middle part of sides 124 and 125. The second channel part 122*b* and 123*b* of guide channels 122 and 123 extends in the insertion direction S from the end of the corresponding first channel part. The function of these guide channels 122 and 123 is also further described below.

Figure 10:
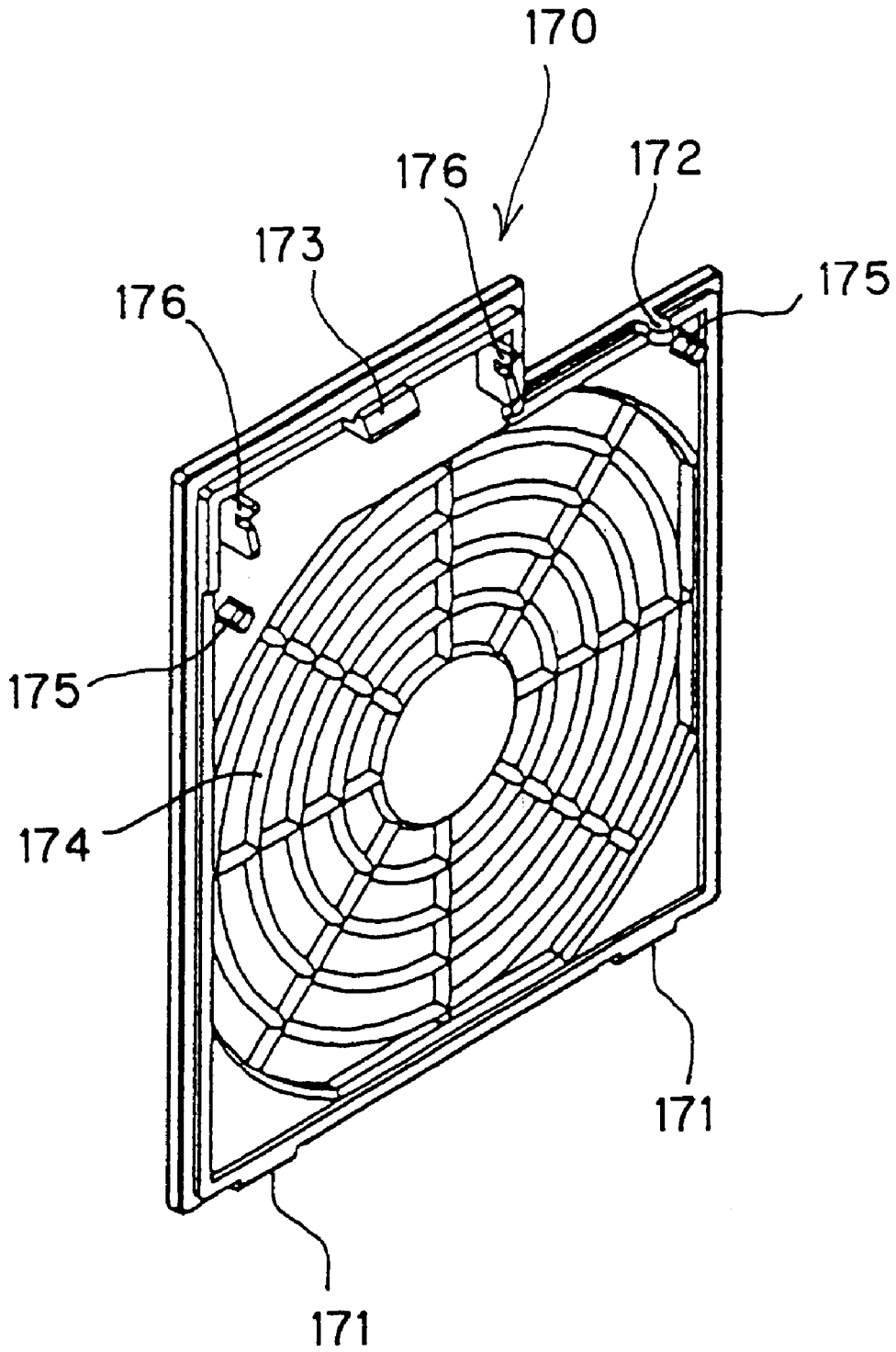
FIG. 10 is a perspective view of the fan housing cover shown in FIG. 1.
Figure 11:
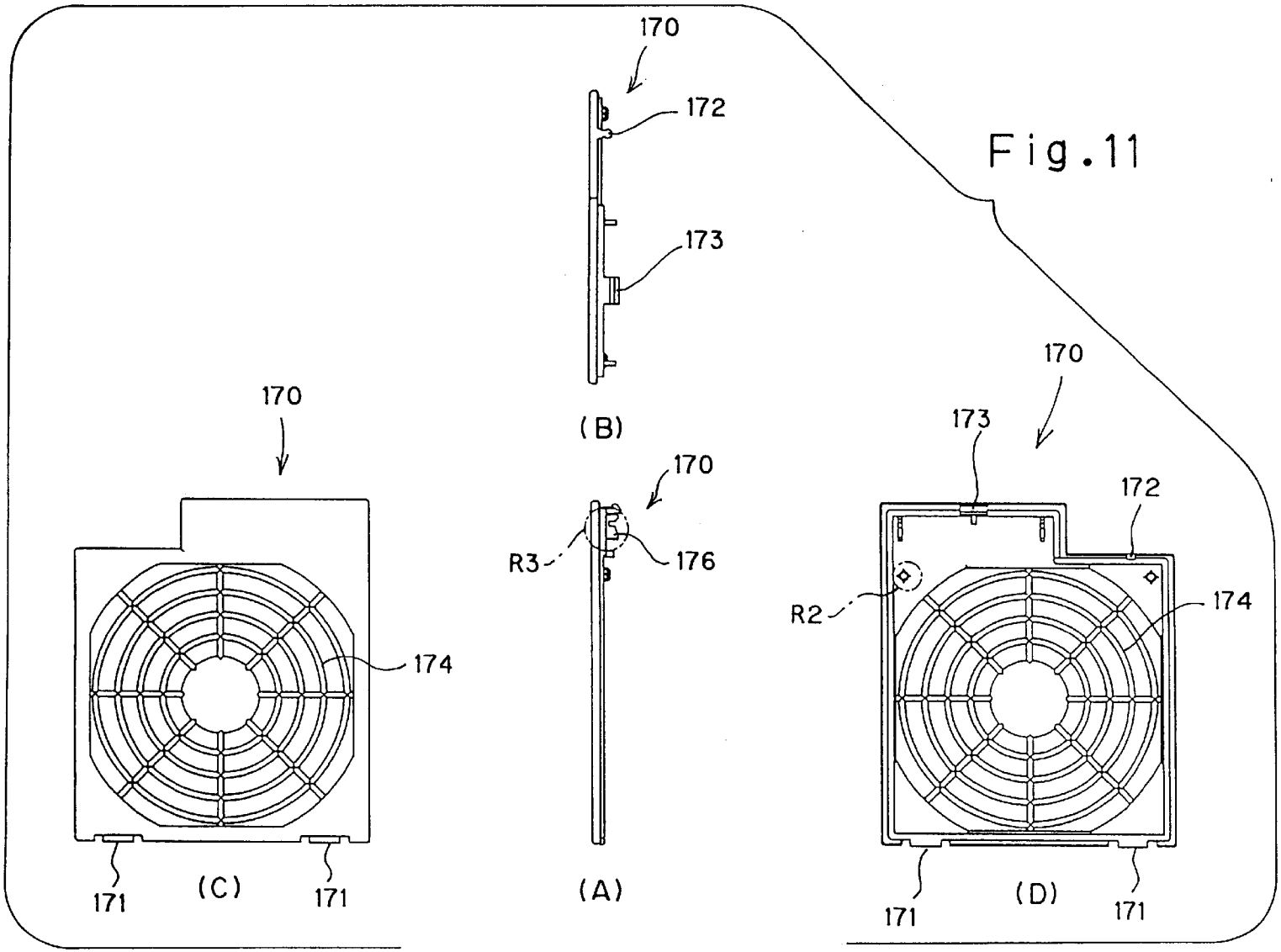
FIGS. 11 shows four side views of the cover shown in FIG. 10((A) to (D) are front, top, left, and right sides views)
Figure 12:
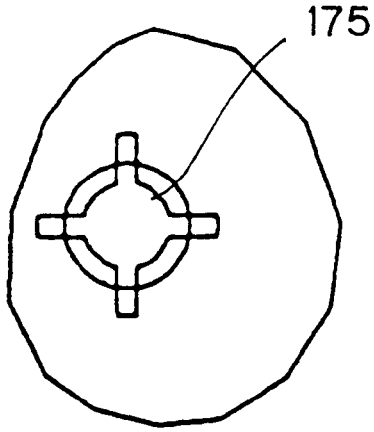
FIG. 12 is an enlarged view of the area inside circle R2 in FIG. 11(D)
Figure 13:
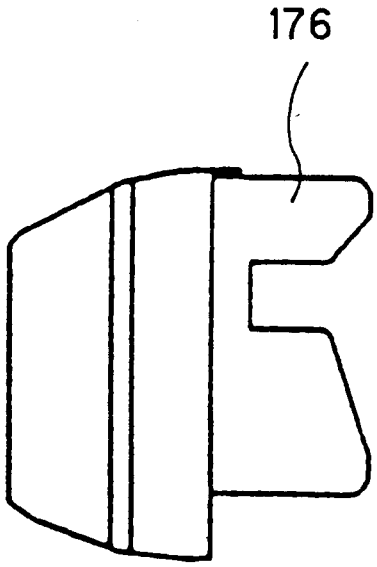
FIG. 13 is an enlarged view of the part shown in circle R3 in FIG. 11(A)

FIG. 10 is a perspective view of the fan housing cover 170. FIGS. 11(A) to (D) are front, top, left, and right sides views of the cover 170. FIG. 12 is an enlarged view of the area inside circle R2 in FIG. 11(D), and FIG. 13 is an enlarged view of the part shown in circle R3 in FIG. 11(A).

The fan housing cover 170 is described in detail below with reference to FIGS. 3 to 5, and FIGS. 10 to 13.

A ventilation opening is formed in the middle of cover 170 with a finger guard 174 formed in the opening. Similarly to the finger guard 116 disposed to box frame 110, the members of this finger guard 174 are thin as shown in the figure so that resistance to air flow is low and noise is kept low.

An engaging protrusion 175 shaped as shown in the enlarged view in FIG. 12 is formed to the inside wall of the cover 170. As are engaging protrusions 117 of the box frame 110, these engaging protrusion 175 are exemplary of the engaging members of the present invention. Further similarly to the engaging protrusions 117 of box frame 110 (see FIG. 7(C)), engaging protrusion 175 fits into mounting hole 153 in fan 150 (see FIGS. 1 and 2) and functions to fasten the fan 150 inside the fan housing.

A forked retainer 176 for holding side 132*b* of printed circuit board 130 (see FIGS. 1 and 2) is also formed on the inside wall of the cover 170. Note that this side 132*b* of printed circuit board 130 is the side opposite side 132*a* held by the slotted retainer 118 (see FIG. 7(C)) of box frame 110. In conjunction with slotted retainer 118 of box frame 110, the forked retainer 176 works to hold the printed circuit board 130 inside the fan housing.

It will thus be obvious that box frame 110 and cover 170 in conjunction with each other have a structure for fixing the printed circuit board 130 and fan 150 inside the fan housing.

The cover 170 is also fixed to the box frame 110 as described above.

A fan unit 100 according to this preferred embodiment of the invention is configured so that it can be easily assembled without using any screws or similar fasteners and without using any tools, and thus facilitates cost reduction.

It will also be noted that this fan unit 100 has finger guards 116 and 174 in both ventilation openings on both sides in the direction of air flow through a fan housing comprising box frame 110 and cover 170. Contact between a finger and the fan 150 is thus prevented, and the fan unit 100 can be safely handled even when the fan 150 is turning at high speed.

Yet further, the box frame 110 and cover 170 of this fan unit 100 are resin moldings, lightweight, and electrically insulated, and are therefore electrically safe to handle even when a live power supply is maintained.

Because they are resin moldings, the finger guards 116 and 174 can also be thinly formed, thus assuring a wide air flow channel, reducing resistance to air flow, and keeping noise to a low level.

Figure 14:
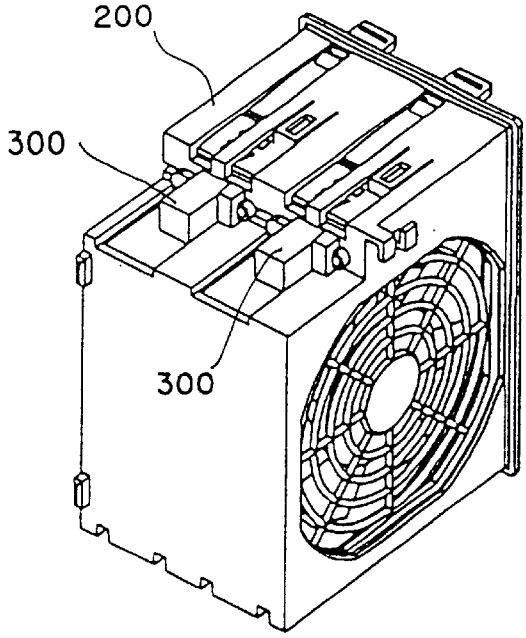
FIG. 14 and FIG. 15 are perspective views from different angles of a fan assembly according to a preferred embodiment of the present invention.
Figure 15:
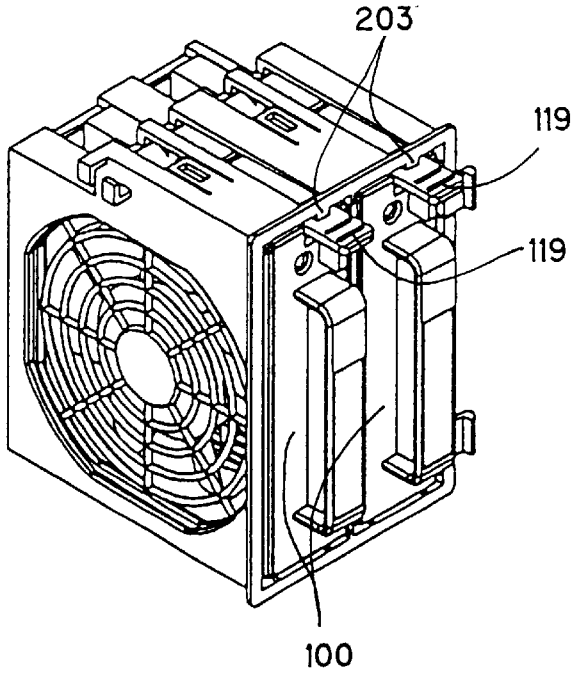
Figure 16:
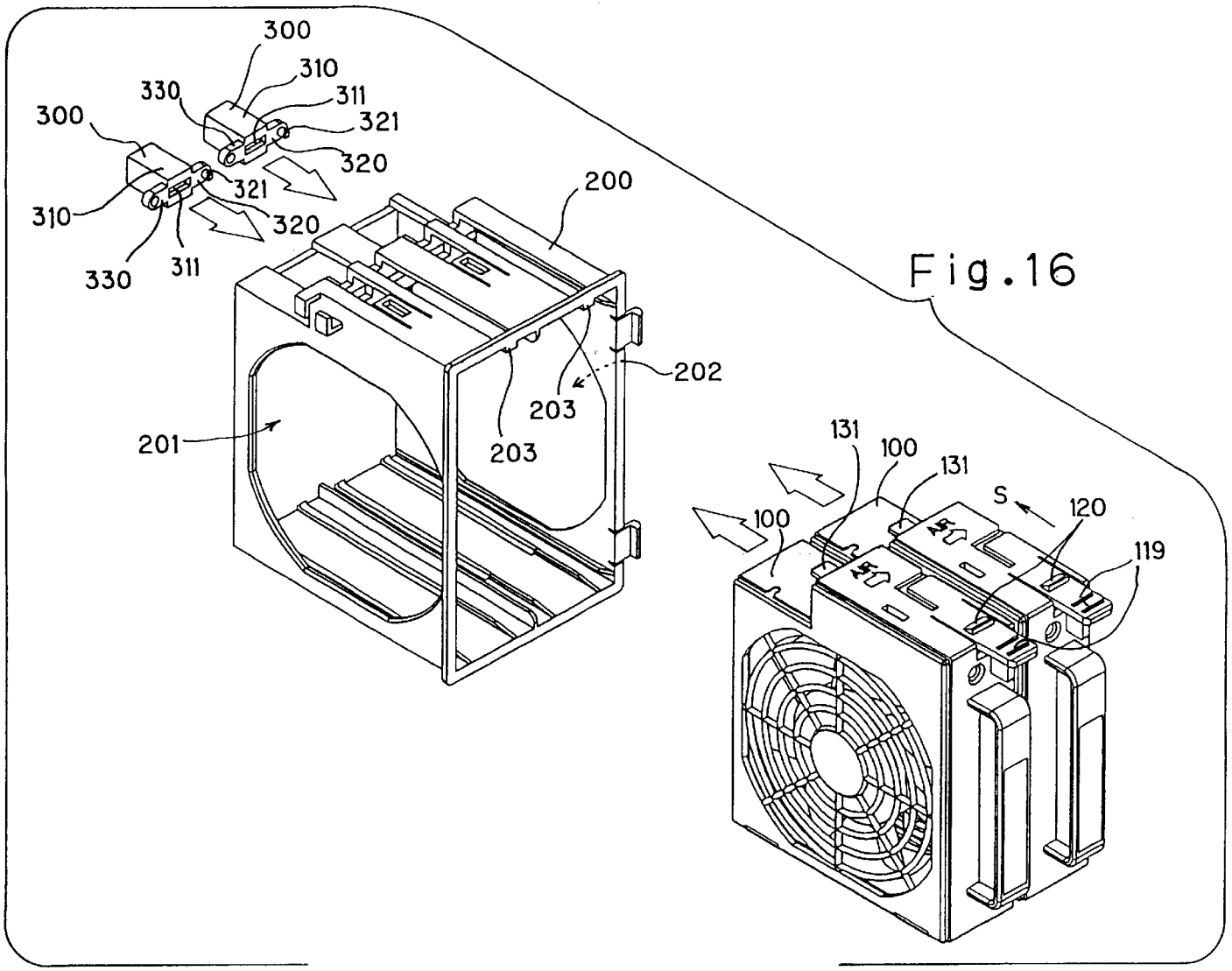
FIG. 16 is an exploded perspective view of the fan assembly shown in FIG. 14 and FIG. 15.
Figure 17:
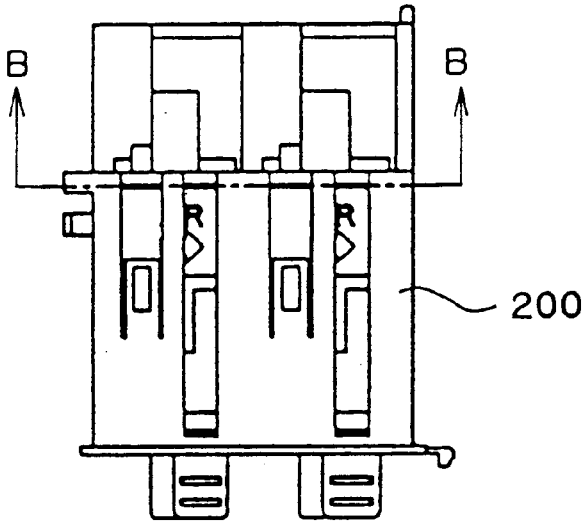
FIG. 17 is a plan view of the fan case of the fan assembly shown in FIG. 14.
Figure 18:
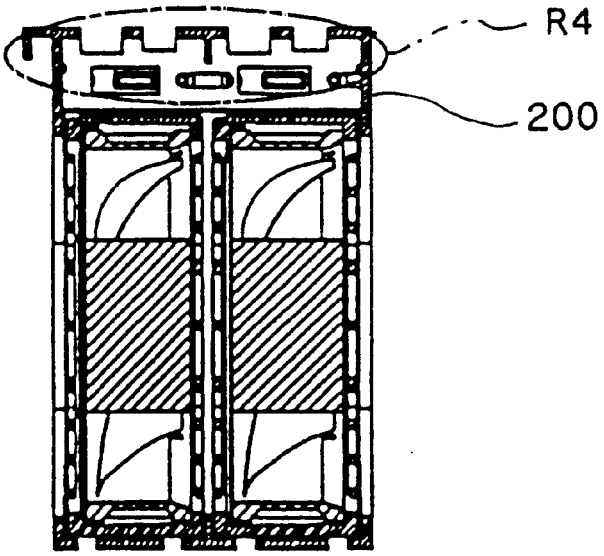
FIG. 18 is a section view through line B—B in FIG. 17.
Figure 19:
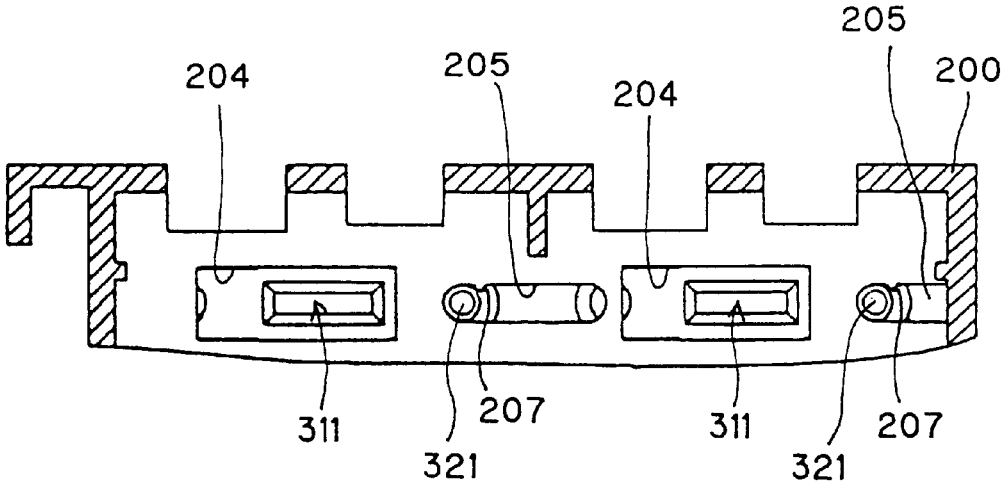
FIG. 19 is an enlarged view of the area in oval R4 in FIG. 18.
Figure 20:
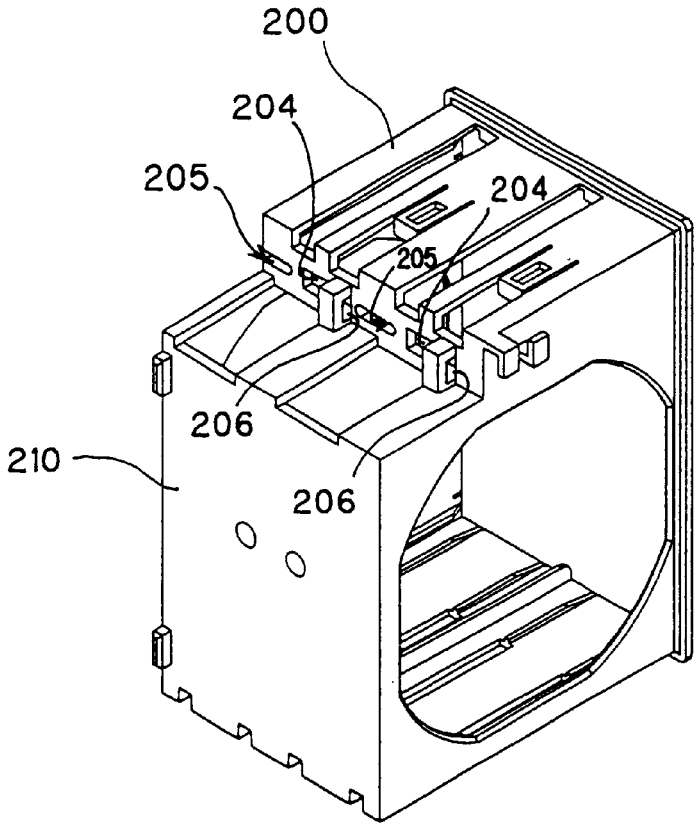
FIG. 20 is a perspective view from the back of the fan case in FIG. 14.
Figure 21:
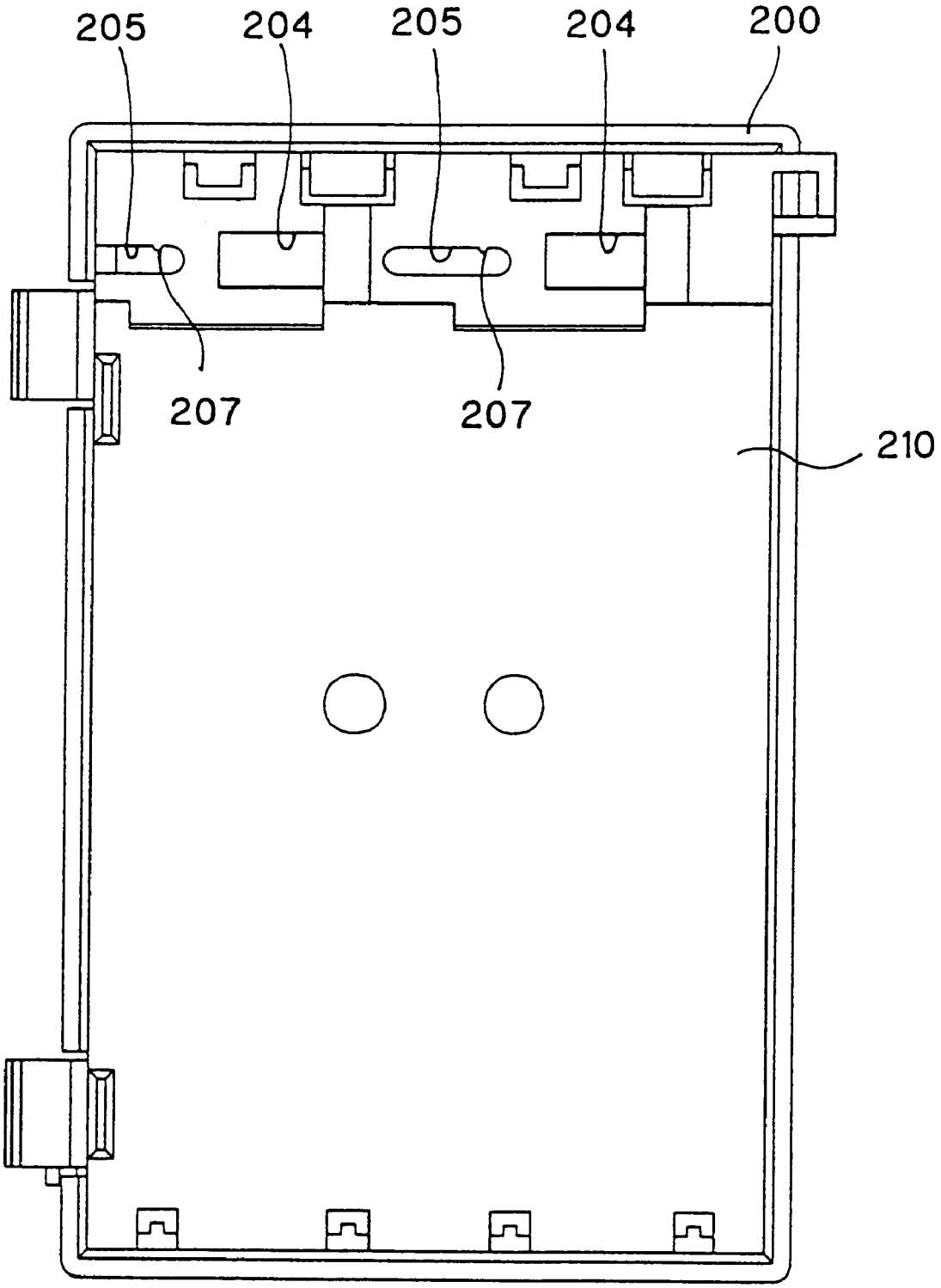
FIG. 21 is a back view of the fan case in FIG. 14.

FIG. 14 and FIG. 15 are perspective views from different angles of a fan assembly according to a preferred embodiment of the present invention. FIG. 16 is an exploded perspective view of this fan assembly, and FIG. 17 is a plan view of the fan case of this fan assembly. FIG. 18 is a section view through line B—B in FIG. 17. FIG. 19 is an enlarged view of the area in oval R4 in FIG. 18. FIG. 20 is a perspective view from the back of the fan case, and FIG. 21 is a back view of the fan case.

As shown in FIG. 16, this fan assembly comprises two fan units 100 as described above, a fan case 200 for holding these two fan units 100 stacked together in the direction of air flow, and two connectors 300 to which a card edge 131 of printed circuit board 130 in the two fan units 100 is inserted. It should be noted that these two fan units 100 are fan units as described above with reference to FIGS. 1 to 13, and further description thereof is thus omitted below.

Fan case 200 has a means for securing these two connectors 300 as further described below. The two fan units 100 are housed in the fan case 200 by sliding them into the fan case 200 in insertion direction S. This action of installing a fan unit 100 into the fan case 200 also fits the card edge 131 of printed circuit board 130 in the fan unit 100 into the corresponding connector 300 fixed to fan case 200.

Ventilation openings 201 and 202 are formed in the walls of the fan case 200 in the direction of air flow. The two fan units 100 housed in the fan case 200 thus move air in the direction of air flow by means of the two fans 150 (see FIG. 1 and FIG. 2) housed in the two fan units 100.

By thus locating two fan units 100 in line in the direction of air flow in this fan assembly, air flow can be maintained even if one of the two fan units 100 fails, and an abnormal rise in the internal temperature of the device in which the fan assembly is installed can thus be prevented.

A removal prevention tab 203 is disposed to the fan case 200 for each fan unit 100 installed therein. When a fan unit 100 is slid in the insertion direction S for installation to the fan case 200, the engaging protrusion 120 formed on the operating lever 119 of the fan unit 100 rides passed the removal A prevention tab 203 and thus holds the fan unit 100 secure inside the fan case 200. Once thus installed, the fan unit 100 cannot be removed from the fan case 200 by simply pulling out on the fan unit 100 because the removal prevention tab 203 interferes with movement of the protrusion 120 in the direction opposite the insertion direction S, and thus prevents fan unit 100 removal. As a result, unintentional removal of the fan unit 100 from the fan case 200 is prevented.

The fan unit 100 can be easily intentionally removed from the fan case 200 by depressing operating lever 119. This causes the operating lever 119 to bend and changes the position of the protrusion 120 on the operating lever 119, thereby disengaging the protrusion 120 and the removal prevention tab 203 [403, sic] and removing the interference therebetween so that the fan unit 100 can be slid out from the fan case 200.

Connector 300 is removably fixed to the fan case 200. The mechanism for thus fitting a connector 300 to the fan case 200 is described next below.

As shown in FIG. 16, this connector 300 comprises a main body 310 and first and second arms 320 and 330 extending to both sides from the body 310. An opening 311 to which card edge 131 of printed circuit board 130 of fan unit 100 is inserted is disposed in the body 310. A forward projecting engaging protrusion 321 is formed to the first arm 320.

A connector opening 204 for exposing opening 311 in the body 310 of connector 300 to the, inside of the fan case 200, and a slot 205 in which engaging protrusion 321 of first arm 320 is inserted and guided, are formed in the wall of back 210 of the fan case 200 (see FIGS. 20 and 21) for each connector 300. An arm engaging hole 206 (sees FIG. 20) to which second arm 330 of connector 300 is inserted is further formed crosswise to back wall 210 of fan case 200. A protrusion 207 projecting to the inside of the slot 205 is further formed in each slot 205 guiding engaging protrusion 321 of first arm 320.

To install a connector 300 to fan case 200, the second arm 330 of the connector 300 is inserted to arm engaging hole 206 of fan case 200, and engaging protrusion 321 of first arm 320 is inserted to slot 205. The connector 300 is then slid in the direction further deeply inserting second arm 330 to arm engaging hole 206. This causes the engaging protrusion 321 on first arm 320 to pass over protrusion 207 projecting inward to slot 205 so that the engaging protrusion 321 of the first arm 320 is fixed at the position shown in FIG. 19 engaged by the protrusion 207 in slot 205. If it becomes necessary to remove the connector 300 [320, sic] from the fan case 200, the connector 300 can be removed by sliding it in the direction removing the second arm 330 from the arm engaging hole 206 while applying force sufficient to move the engaging protrusion 321 of the first arm 320 back over the protrusion 207 in slot 205.

It will thus be obvious that a fan case 200 according to this preferred embodiment of the invention is constructed so that a connector 300 can reliably be removably installed to the fan case 200 without using any tools. In addition, when the connector 300 is installed to the fan case 200 and a fan unit 100 is then installed to the fan case 200, the action of installing the fan unit 100 causes the card edge 131 of the printed circuit board 130 of fan unit 100 to be fit into and connected to the connector 300.

This fan assembly can therefore be extremely easily assembled. In addition, a fan unit 100 can be replaced in the fan case 200 safely and easily even while current is supplied to the connector 300.

Figure 22:
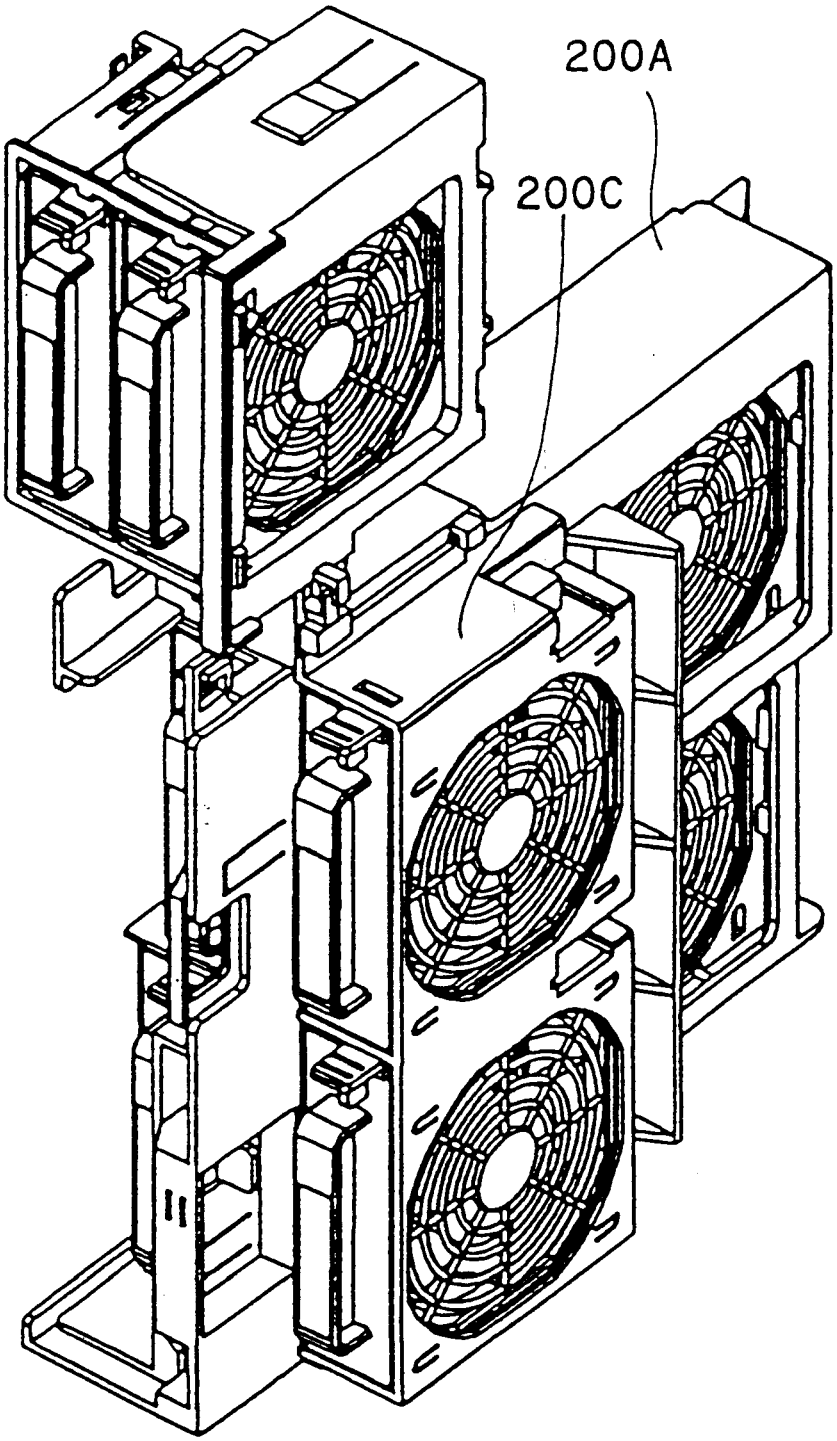
FIG. 22 and FIG. 23 are perspective views from different angles of a fan assembly according to another preferred embodiment of the present invention.
Figure 23:
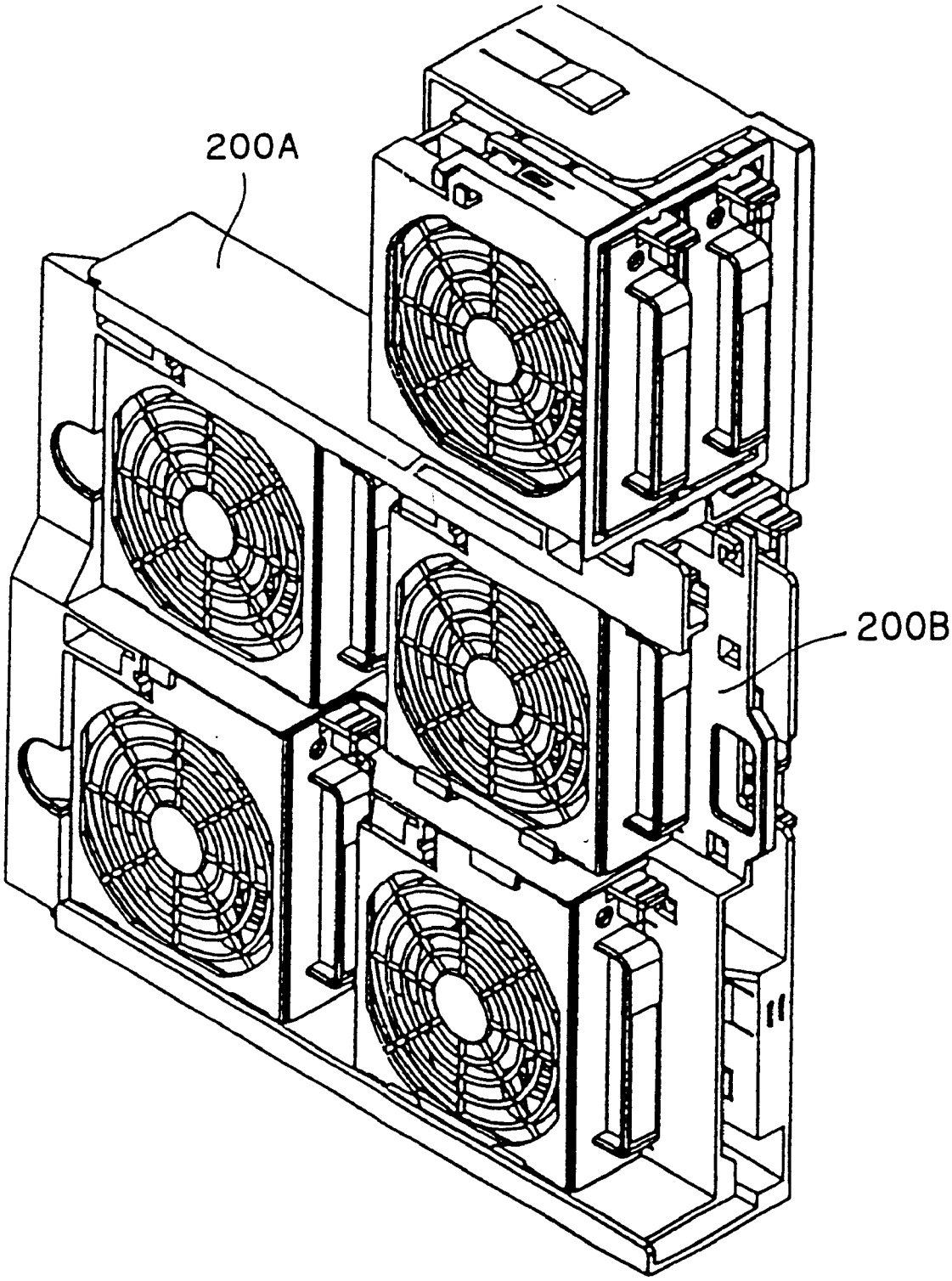
Figure 24:
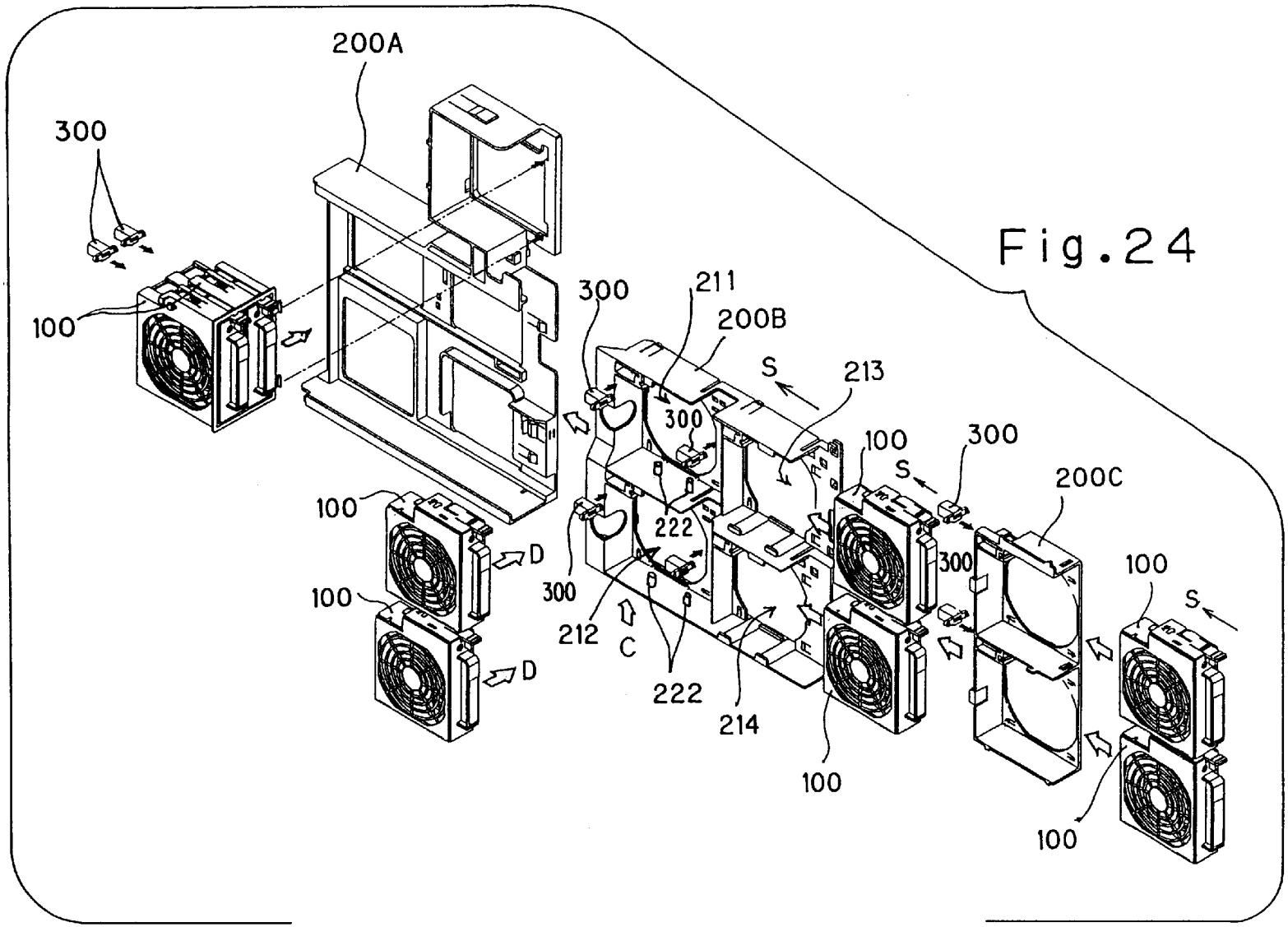
FIG. 24 is an exploded perspective view of the fan assembly shown in FIG. 22.
Figure 25:
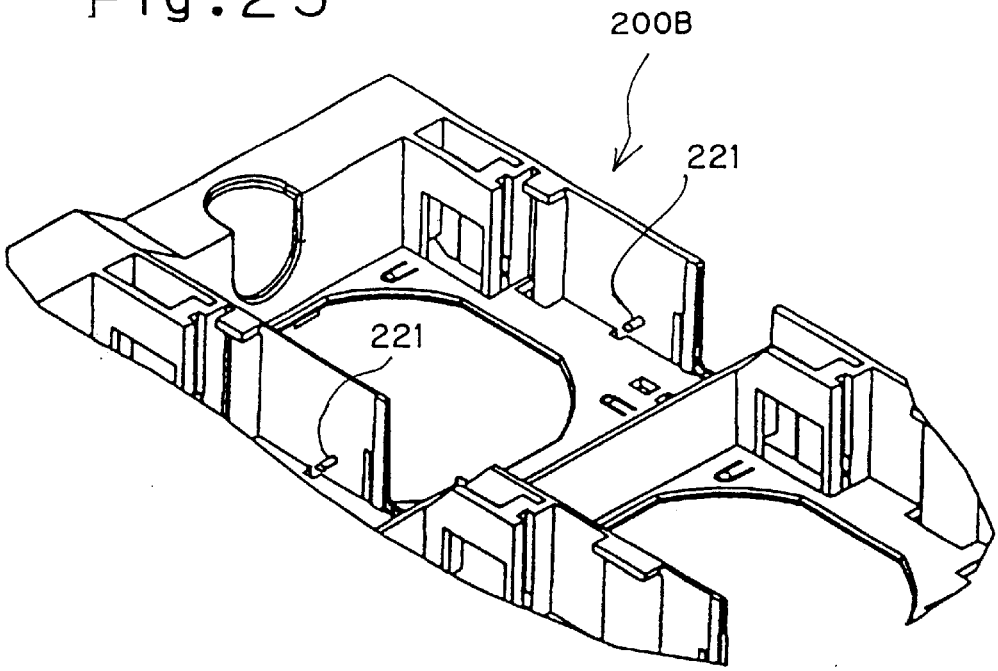
FIG. 25 is a perspective view of part of the second fan case of the fan assembly shown in FIG. 22 as seen from the direction of arrow C in FIG. 24.

FIG. 22 and FIG. 23 are perspective views from different angles of a fan assembly according to another preferred embodiment of the present invention. FIG. 24 is an exploded perspective view of this same fan assembly. FIG. 25 is a perspective view of part of the second fan case of the fan assembly according to this embodiment as seen from arrow C in FIG. 24.

A fan assembly according to this preferred embodiment of the invention comprises eight fan units 100, first to third fan cases 200A, 200B, and 200C, and eight connectors 300 corresponding to the eight fan units 100.

Two fan units 100 are housed in part of first fan case 200A. Four fan units 100 are housed in second fan case 200B. This second fan case 200B is removably housed in the first fan case 200A by sliding the second fan case 200B in insertion direction S to the first fan case 200A. Two fan units 100 are installed to third fan case 200C by sliding them in insertion direction S. This third fan case 200C is supported on and fixed to first fan case 200A.

It should be noted that this second fan case 200B is designed to house two fan units 100 stacked vertically to each other, and two side by side in the insertion direction S. The second fan case 200B comprises four sections 211, 212, 213, and 214 each holding one fan unit 100. Of these, the two sections 213, 214 at the back in the insertion direction S are designed so that the fan unit 100 held therein is inserted from the back in the insertion direction S. Fan units 100 are installed to the two sections 211, 212 at the front in this same direction S by first sliding the fan unit 100 into the second fan case 200B in the direction indicated by arrow D in FIG. 24, and then sliding the fan unit 100 in the insertion direction S. This installation method is achieved as described below.

Figure 26:
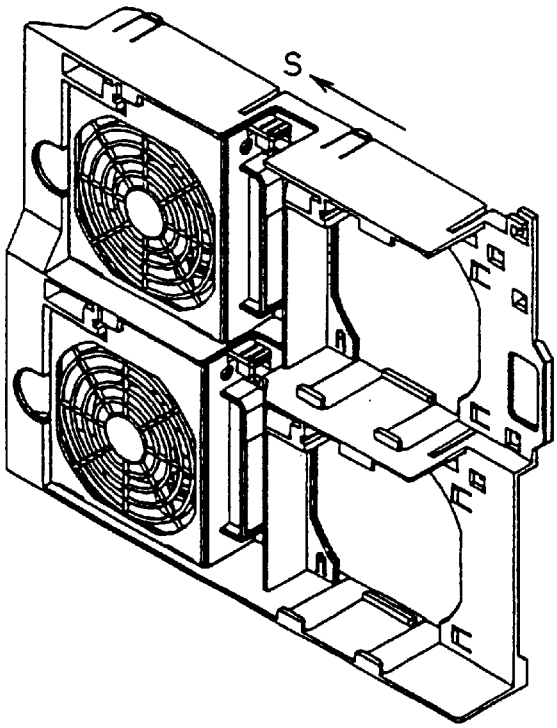
FIG. 26 is a perspective view showing fan units installed to the two front sections of the second fan case in the fan case insertion direction.
Figure 27:
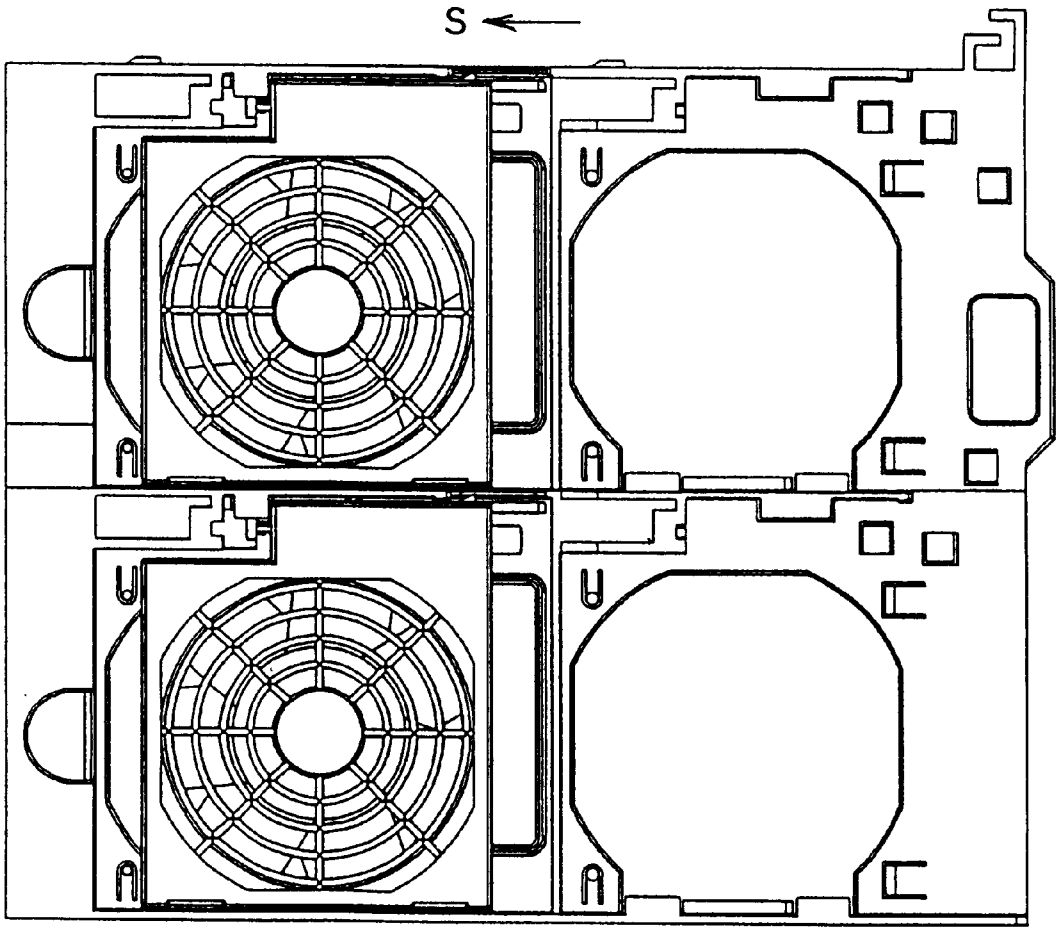
FIG. 27 is a front view showing fan unit installation to the two front sections of the second fan case in the fan case insertion direction before the installation is completed.
Figure 28:
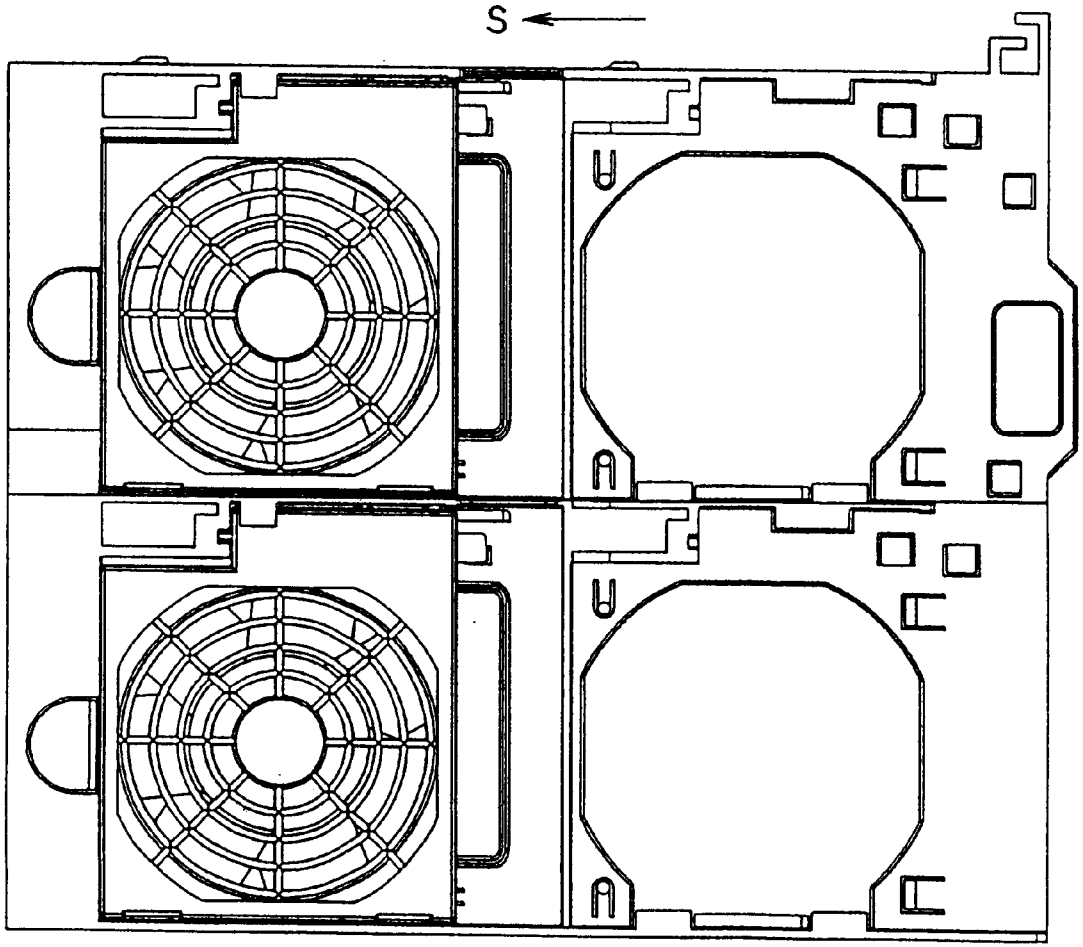
FIG. 28 is a front view showing the fan units when completely installed to the two front sections shown in FIG. 27.
Figure 29:
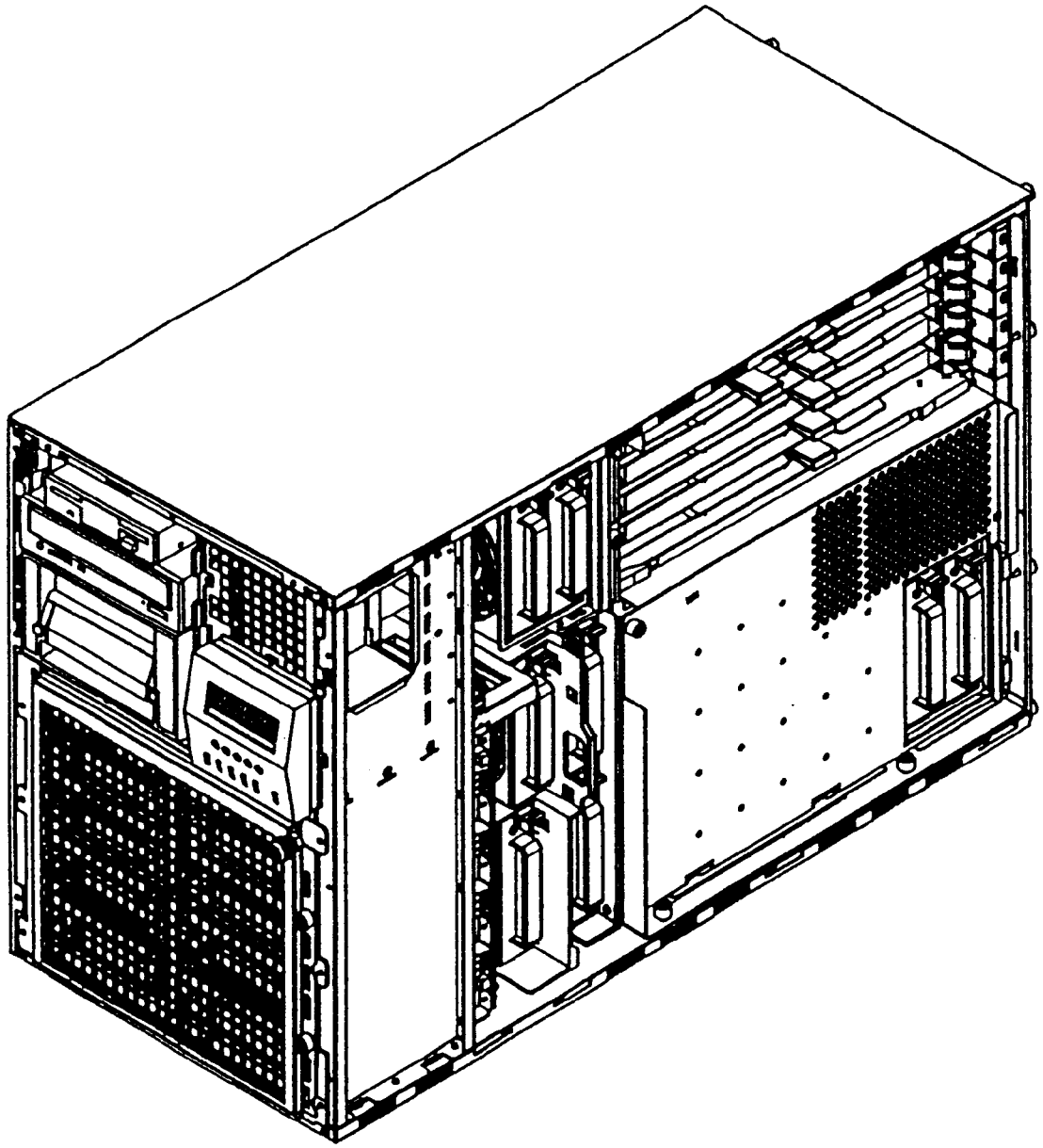
FIG. 29 is a perspective view of an apparatus in which the fan assembly shown in FIGS. 22 to 25 is used when the fan assembly is fully installed to said apparatus.
Figure 30:
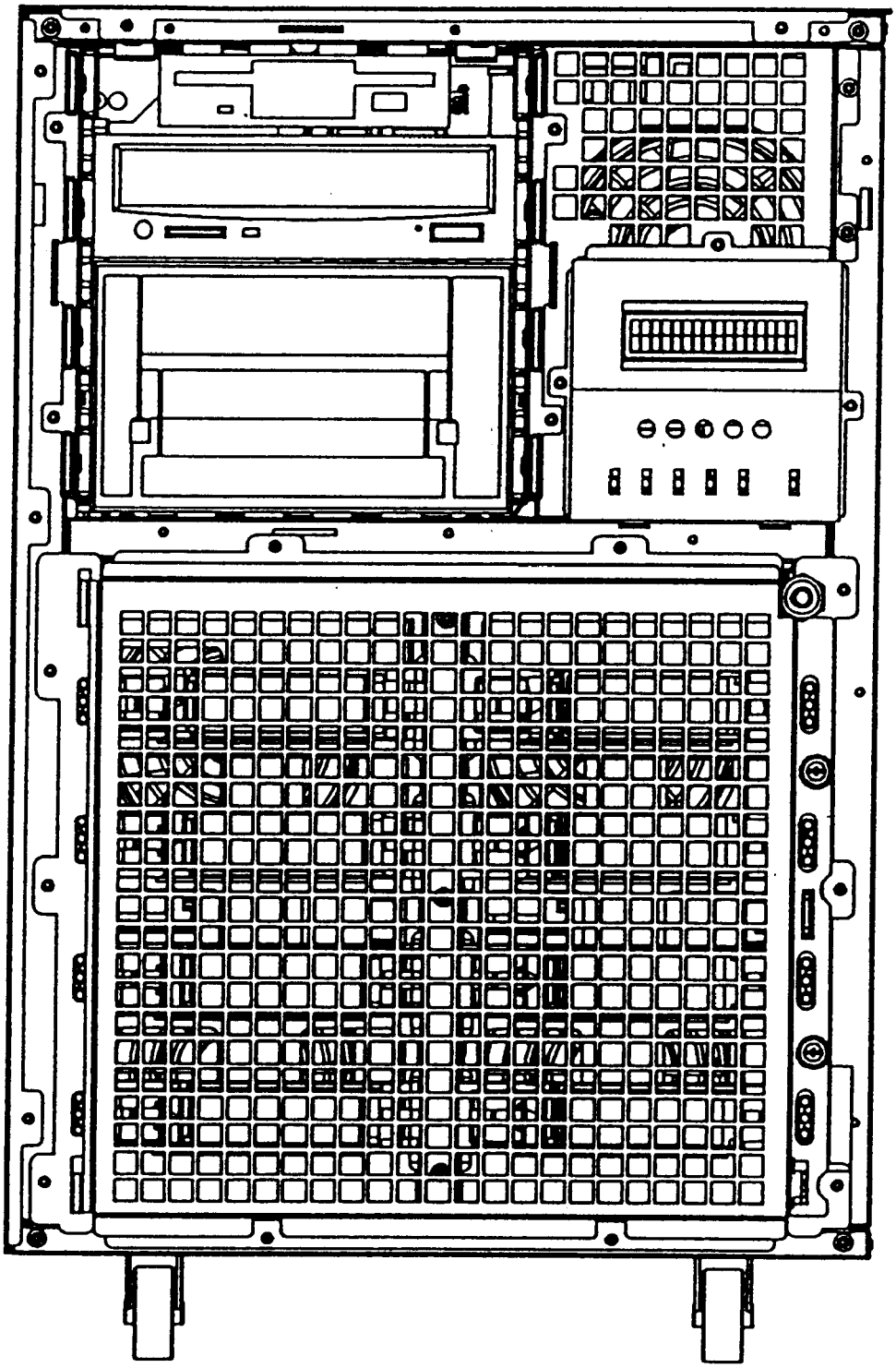
FIG. 30 is a front view of an apparatus in which the fan assembly shown in FIGS. 22 to 25 is used when the fan assembly is fully installed to said apparatus.
Figure 31:
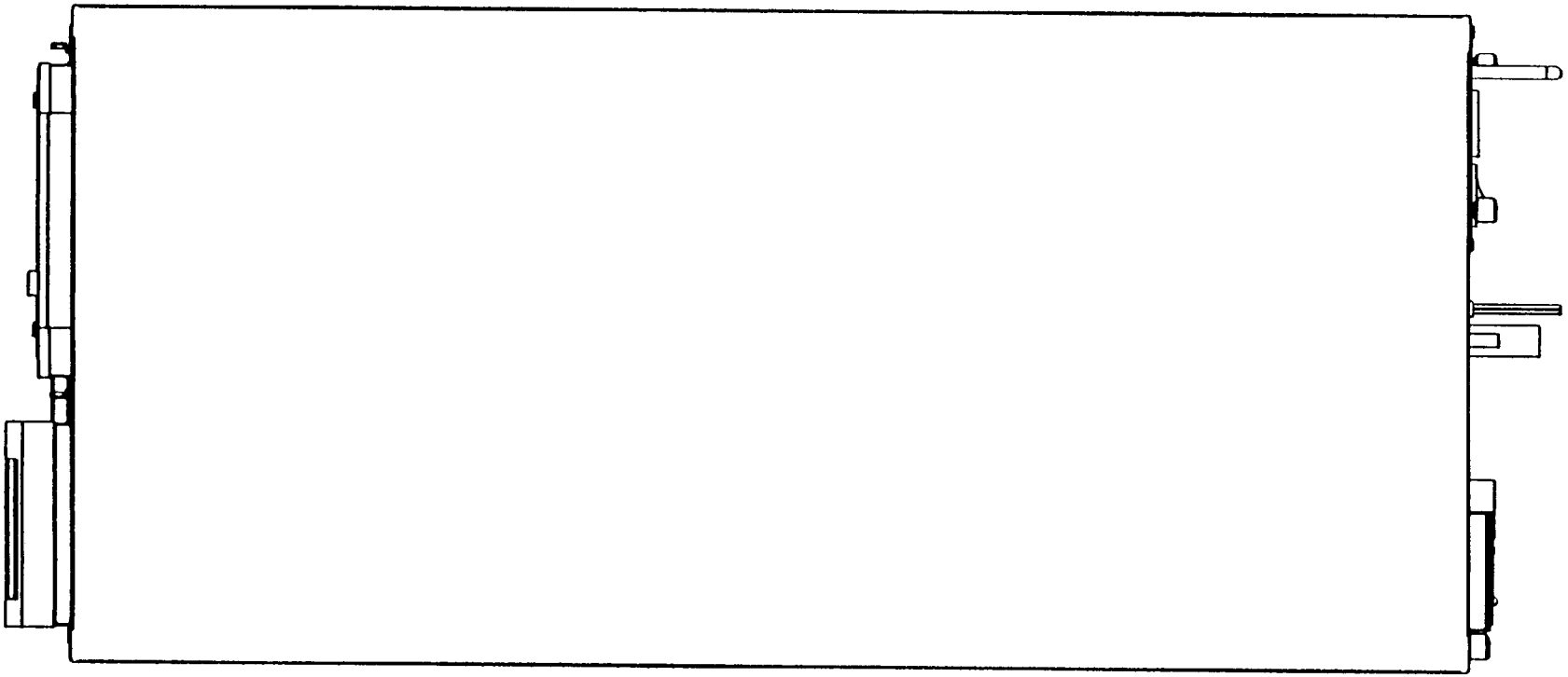
FIG. 31 is a plan view of an apparatus in which the fan assembly shown in FIGS. 22 to 25 is used when the fan assembly is fully installed to said apparatus.
Figure 32:
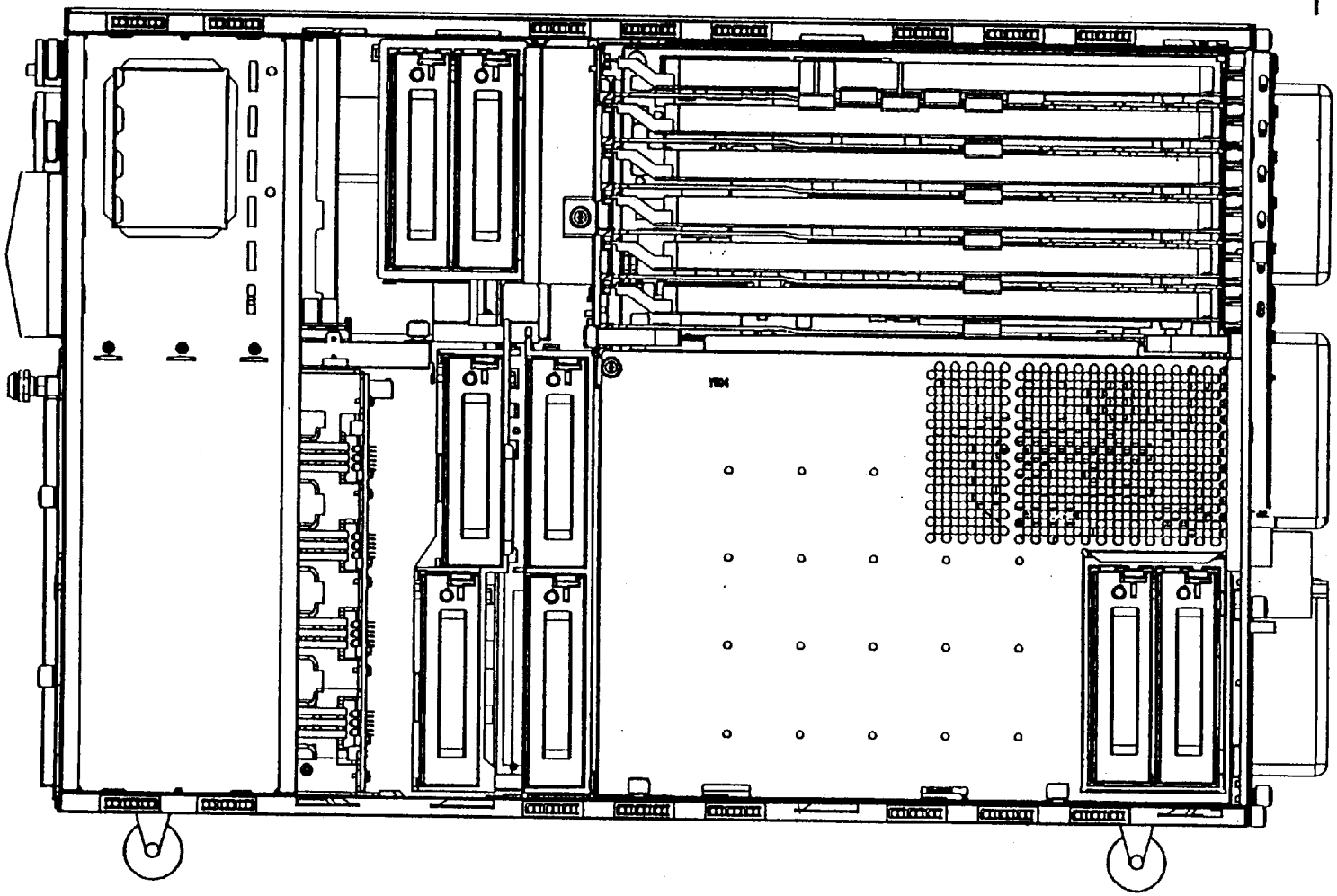
FIG. 32 is a side view of an apparatus in which the fan assembly shown in FIGS. 22 to 25 is used when the fan assembly is fully installed to said apparatus.
Figure 33:
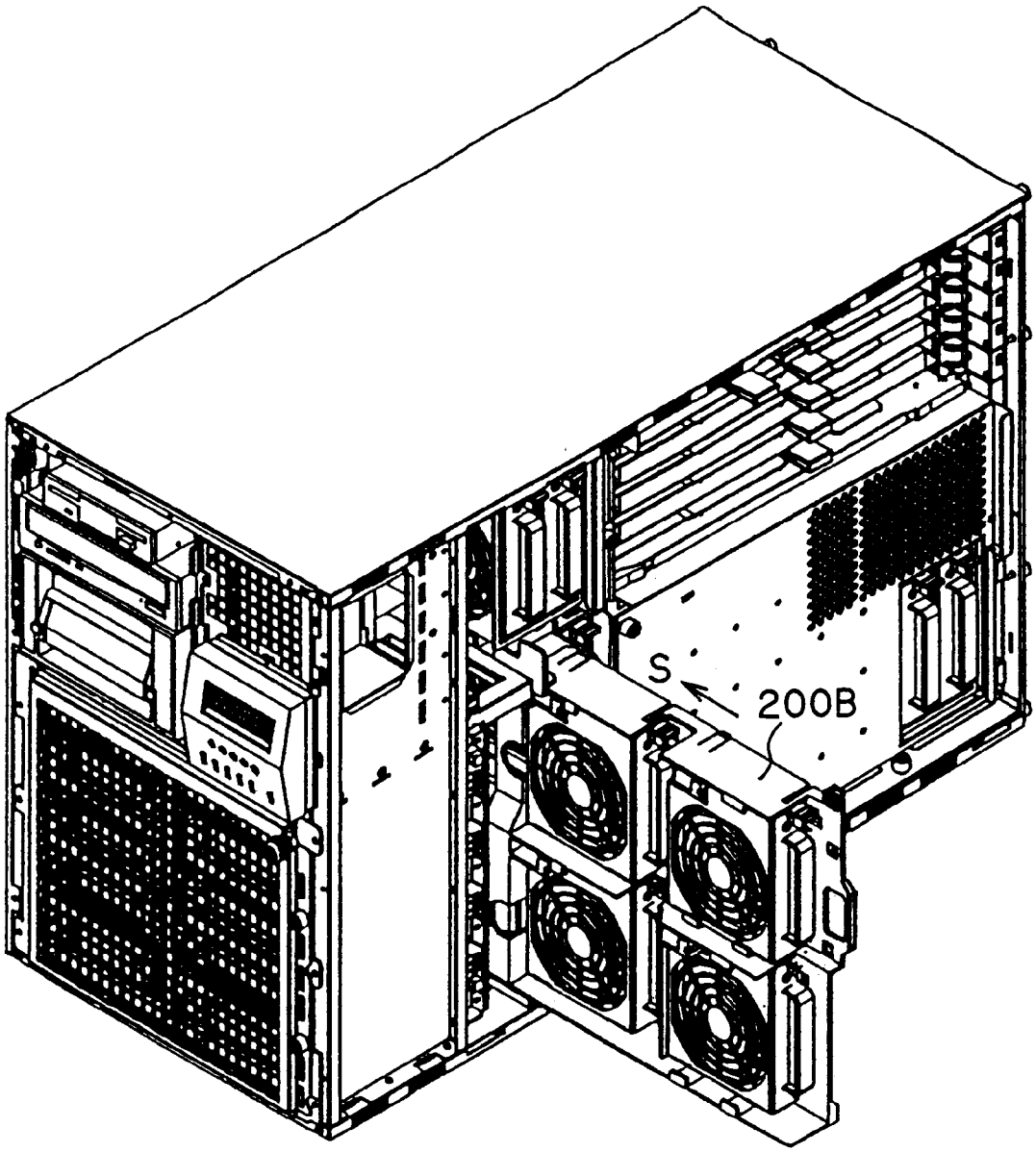
FIG. 33 is a perspective view showing the second fan case 200B of the fan assembly installed to the apparatus shown in FIG. 29 withdrawn from said apparatus.

FIG. 26 is a perspective view showing fan units installed to the two front sections of the second fan case in the insertion direction S. FIG. 27 is a front view showing fan unit installation to these sections before the installation is completed, and FIG. 28 is a front view showing the fan units when completely installed to these front sections.

Two guide protrusions 222 are formed on the bottom of the two sections 211, 212 to the front of second fan case 200B in the direction of arrow S as shown in FIG. 24. As shown in FIG. 25, a single guide protrusion 221 is also formed in the top of these two front sections 211, 212.

As shown in FIGS. 5(A) and (E), L-shaped guide channels 122 and 123 are formed in fan unit 100. To install a fan unit 100 to front section 211 or 212, bottom guide protrusions 222 of front section 211, 212 in second fan case 200B are fit into the first channel part 123*a* of guide channel 123, top guide protrusion 221 of front section 211, 212 is fit into the first channel part 122*a* of guide channel 122 of fan unit 100, and the fan unit 100 is then slid in the direction of arrow D (see FIG. 24). FIG. 27 is a front view of this position.

When the guide protrusions 221, 222 advance to the bend in the L-shaped guide channels 122 and 123 and enter the second channel part 122*b* and 123*b* of guide channels 122 and 123, the fan unit 100 is slid in the direction of arrow S (the insertion direction) relative to the fan case 200 to completely house the fan unit 100 in the corresponding front section 211, 212 of the second fan case 200B.

The second sliding step of this operation fits the card edge 131 of printed circuit board 130 of fan unit 100 into the corresponding connector 300. The protrusion 120 on operating lever 119 of fan unit 100 is also slid passed a removal prevention protrusion (not shown in the figures) in each front section 211, 212 whereby unintentional removal of the fan unit 100 is prevented. It should be noted that this removal prevention protrusion is identical to the removal prevention tab 203 of the fan case 200 described in the preferred embodiment shown in FIG. 16.

FIG. 29 to FIG. 32 are a perspective view, front view, plan view, and side view, respectively, of a product in which the fan assembly shown in FIGS. 22 to 25 is used when the fan assembly is fully installed to said product. FIG. 33 to FIG. 36 are a perspective view, front view, plan view, and side view, respectively, showing the second fan case 200B of the fan assembly installed to said product being removed therefrom.

Figure 34:
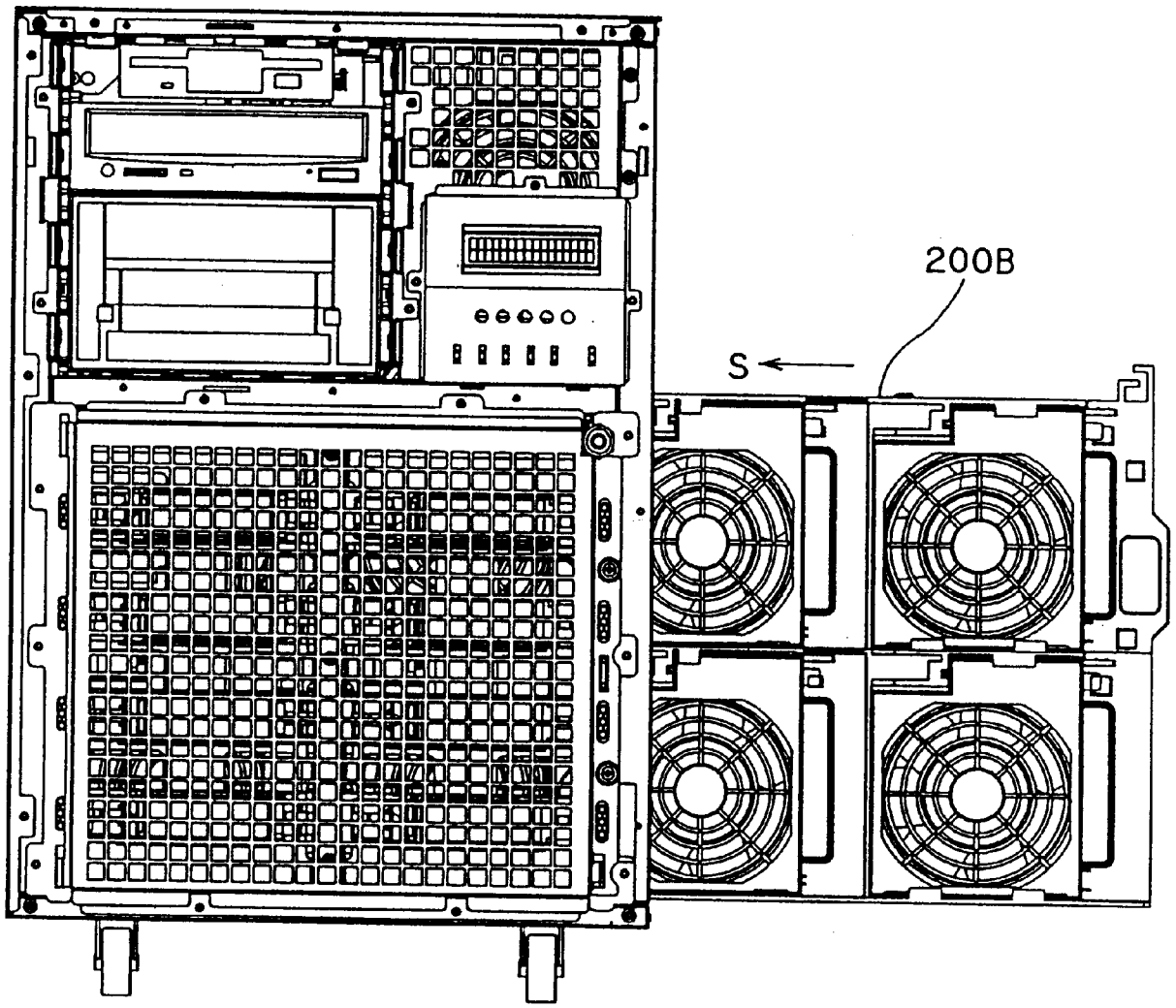
FIG. 34 is a front view showing the second fan case 200B of the fan assembly installed to the apparatus shown in FIG. 29 withdrawn from said apparatus.
Figure 35:
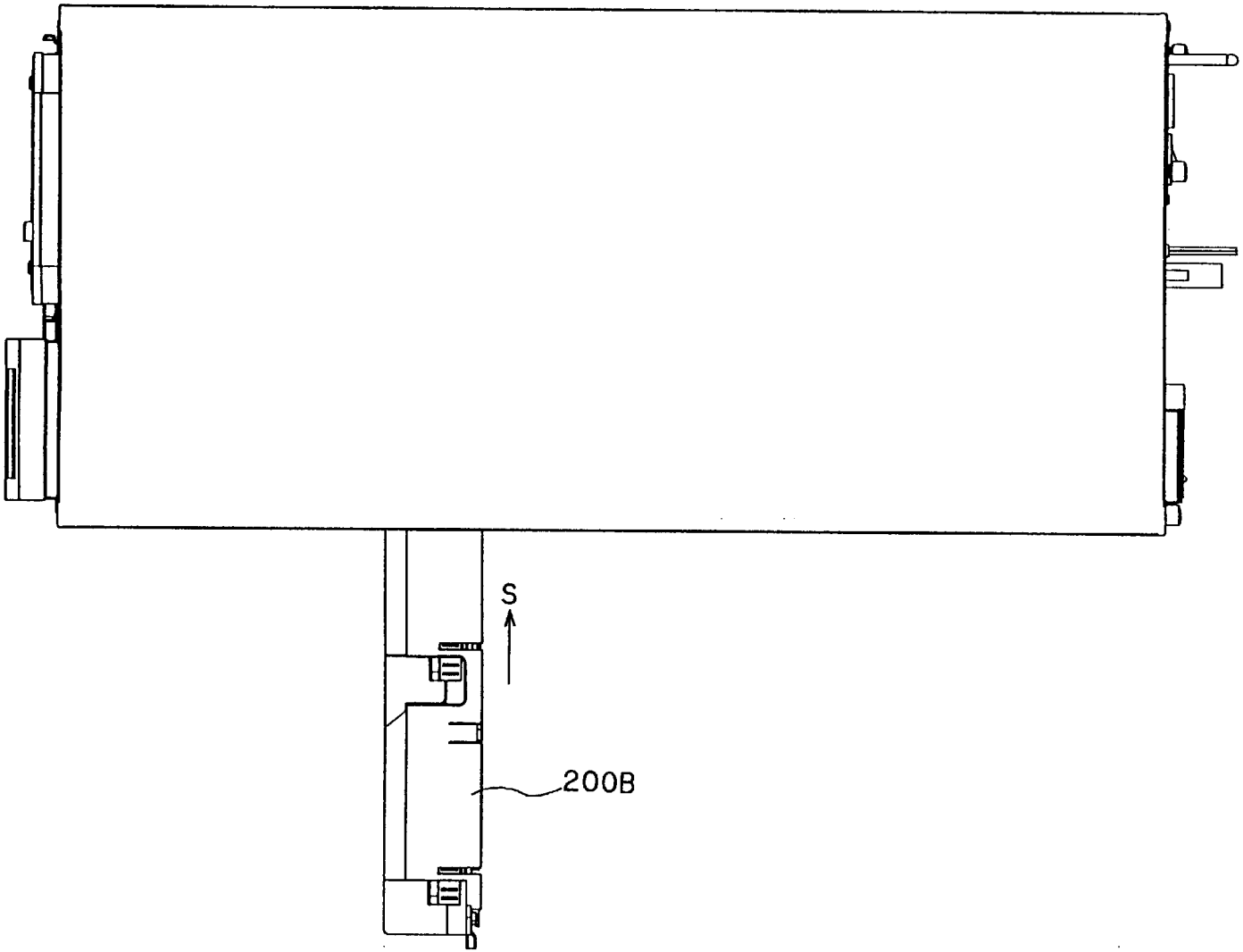
FIG. 35 is a plan view showing the second fan case 200B of the fan assembly installed to the apparatus shown in FIG. 29 withdrawn from said apparatus.
Figure 36:
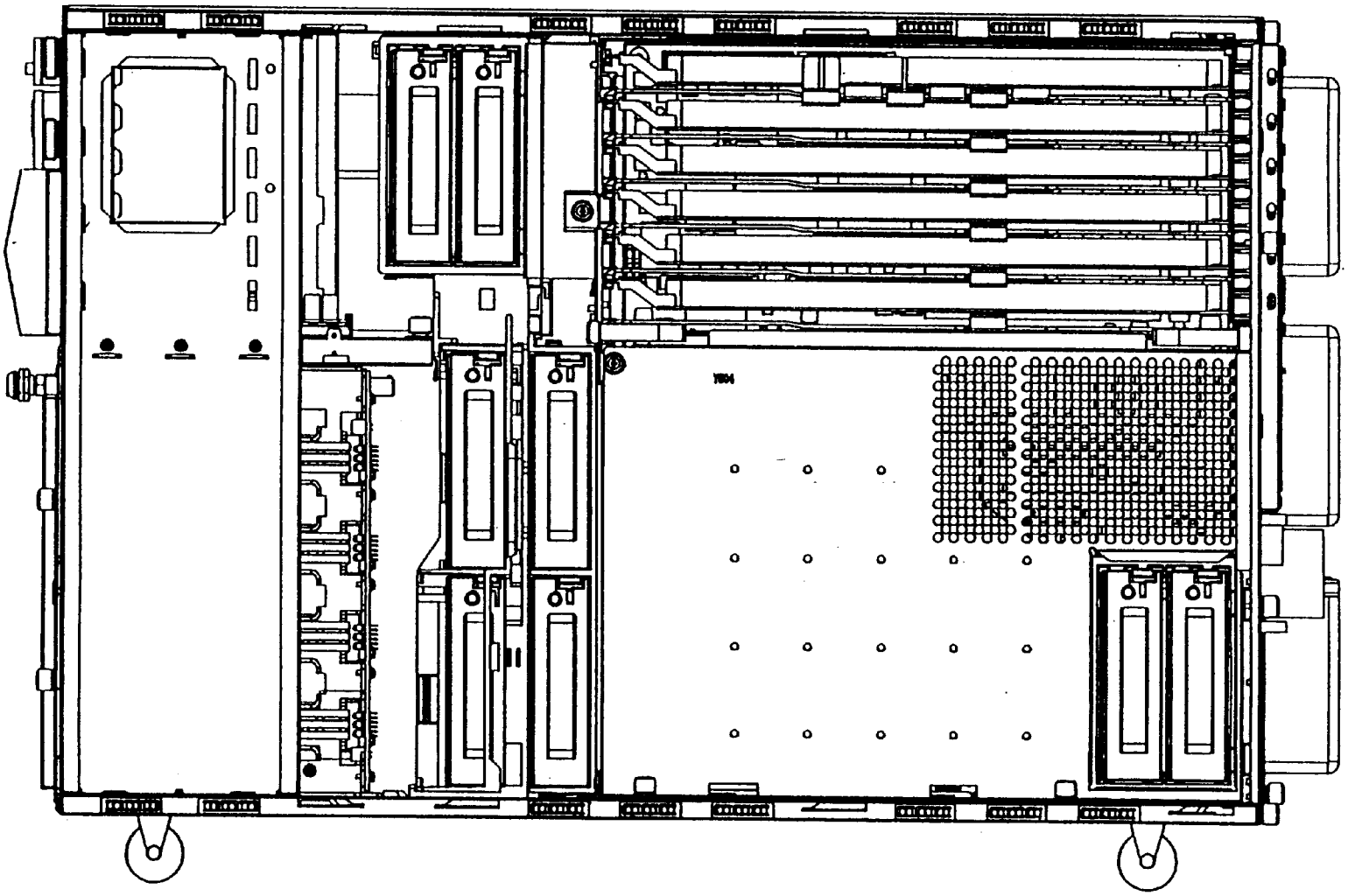
FIG. 36 is a side view showing the second fan case 200B of the fan assembly installed to the apparatus shown in FIG. 29 withdrawn from said apparatus.
Figure 37:
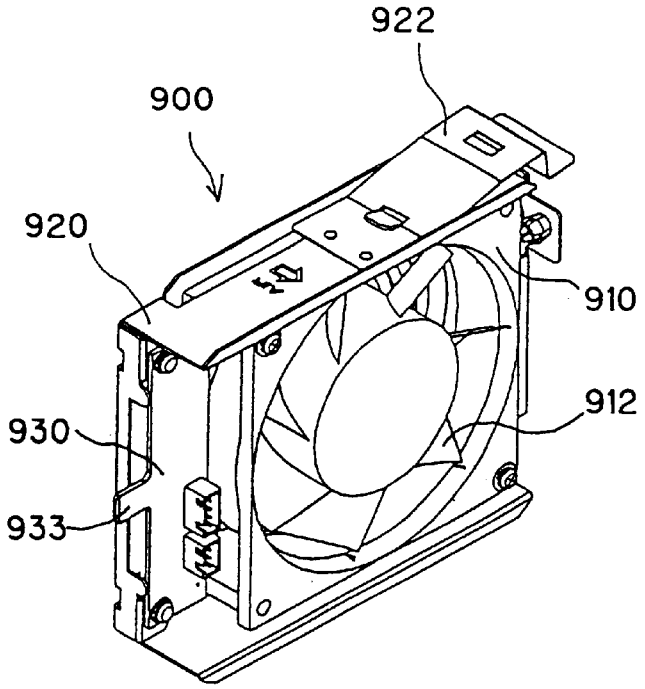
FIG. 37 and FIG. 38 are perspective views from different directions of a fan unit according to the related art.
Figure 38:
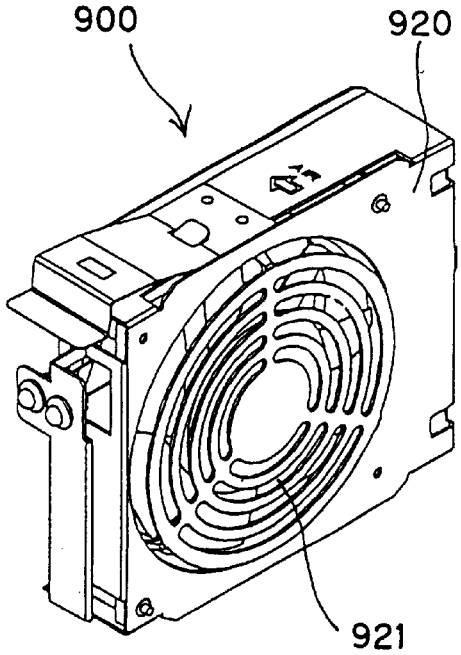
Figure 39:
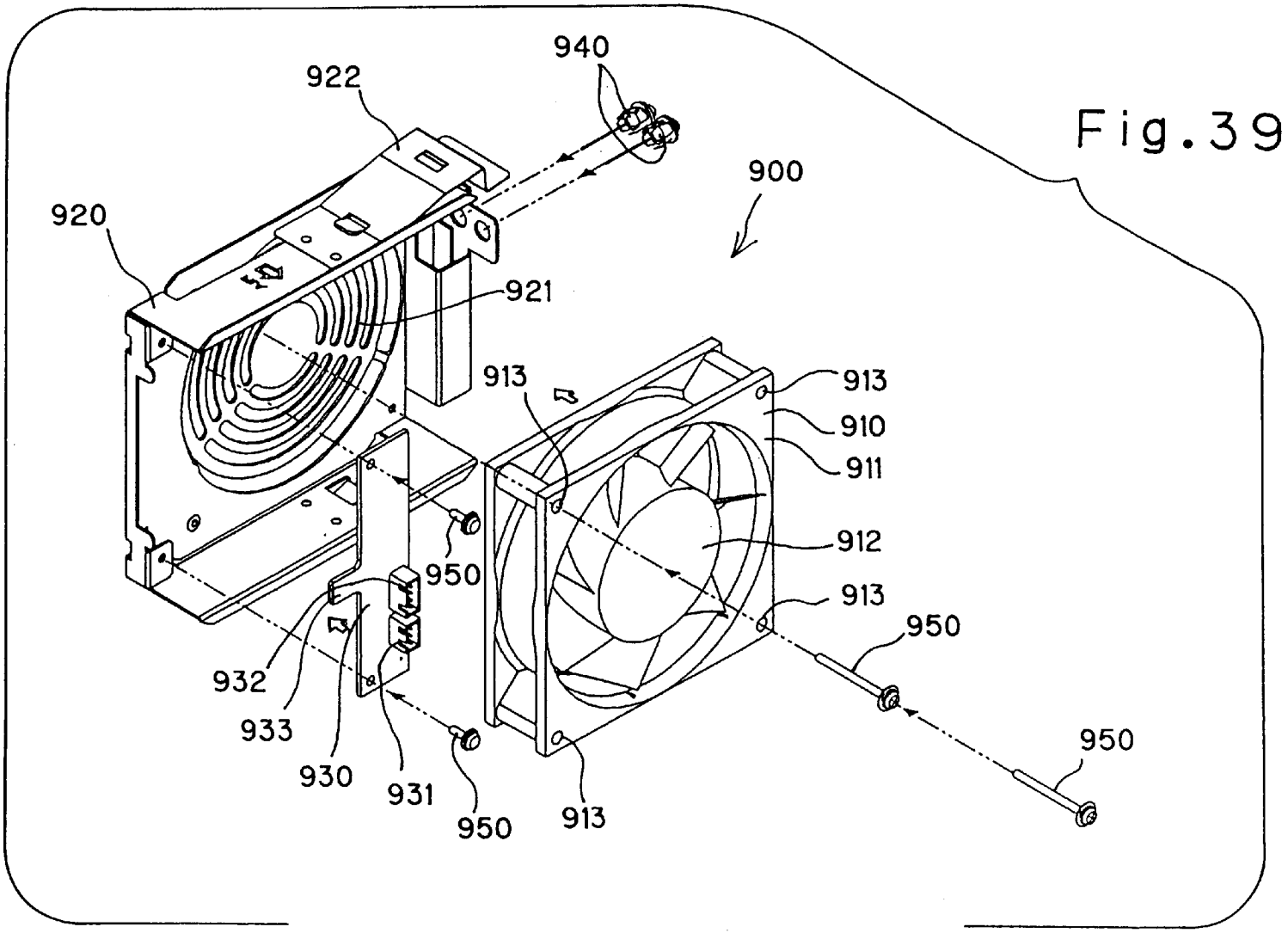
FIG. 39 is an exploded perspective view of the fan unit shown in FIG. 37 and FIG. 38.

This second fan case 200B can be withdrawn from the product to a position as shown in FIGS. 33 to 36 (note particularly FIG. 34). When withdrawn to this position the two fan units housed in the two front sections in the direction of arrow S (insertion direction) cannot be pulled out to the back (the direction opposite arrow A) because of the two fan unit housing sections disposed to this back side. However, by moving the fan unit in the reverse of the L-shaped movement of the fan unit during installation, the fan unit can be removed from the second fan case 200B for maintenance or replacement of the fan units housed at the front in the insertion direction of the second fan case 200B.

By thus installing and removing a fan unit to and from the fan case using an L-shaped movement as described above, a fan unit can be installed to a fan case or removed therefrom as needed even when the space available is confined as shown in FIG. 34.

It will be obvious that a fan assembly according to the present invention shall not be limited to the two preferred embodiments described above, and other variations using a configuration in which the fan unit of the present invention can be installed and removed in a cassette-like manner will be readily apparent to one with ordinary skill in the related art.

As described above, the present invention provides a fan unit that is easy to assemble, low cost, and extremely safe; a fan assembly that is easy to assemble and maintain; and an apparatus in which fan maintenance and replacement are simple.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A fan unit comprising:

a fan having a frame, a fan blade freely rotatable to said frame, and an installation member disposed to said frame;

a fan housing box frame having a bottom surface surrounded by side walls extending to a top surface thereof to form an opening at the top surface for disposing internally thereto said fan, a ventilation opening in the bottom surface, and an engaging member formed on an inside wall for engaging said installation member of the internally disposed fan and determining said fan position; and a fan housing cover for engaging said fan housing frame so as to cover the top surface opening in said fan housing frame, and securing said fan disposed internally to said fan housing frame in conjunction with said fan housing frame, said fan housing cover having a ventilation opening, and an engaging member on an inside wall for engaging said installation member of the fan internally disposed to said fan housing frame.

2. A fan unit according to claim 1, further comprising:

a finger guard formed to said bottom surface opening of the fan housing frame; and a finger guard formed to said opening in the fan housing cover.

3. A fan unit according to claim 1, further comprising:

a printed circuit board having on one end a card edge for connecting by insertion to a connector, and having mounted thereon a control circuit for controlling fan blade rotation;

wherein the fan housing frame further has an opening for passing said card edge of a printed circuit board disposed internally to said fan housing frame outside the fan housing to the front in a specific insertion direction intersecting a direction of air flow of air moved by said fan, and a retainer on an internal wall for holding a side of said printed circuit board disposed internally to said fan housing frame;

said fan housing cover further has on an internal wall a retainer for holding the printed circuit board side opposite to said above-noted side of a printed circuit board disposed internally to said fan housing frame; and said fan housing cover in conjunction with said fan housing frame secures a printed circuit board disposed internally to said fan housing frame.

4. A fan unit according to claim 1, wherein:

the fan housing frame further comprises a cantilevered beam-shaped operating lever extending backwards relative to a specific insertion direction intersecting a direction of air flow of air moved by said fan, said operating lever having an engaging member for preventing removal of a fan unit from a fan case when the fan unit is installed to the fan case for housing the fan unit, said engaging member formed in a middle part between operating lever ends.

5. A fan assembly comprising:

a fan case for housing a fan unit, said fan unit comprising a fan having a frame and a fan blade freely rotatable to said frame;

a printed circuit board having on one end a card edge for connecting by insertion to a connector, and having mounted thereon a control circuit for controlling fan blade rotation; and a fan housing having side walls for internally housing said fan therein, internally housing said printed circuit board with said card edge projecting externally to the front in a specific insertion direction intersecting a direction of air flow of air moved by said fan, and having a ventilation opening on both walls in said direction of air flow; and a connector freely removably fixed to the fan case, the connector being connected with the card edge of the printed circuit board projecting forward in the insertion direction by an operation installing the fan unit to the fan case.

6. A fan assembly according to claim 5, wherein:

said connector has a body with an opening for inserting said card edge of the printed circuit board, first and second arms projecting to both sides from said body, and an engaging protrusion formed on said first arm; and said fan case has an arm engaging hole for holding said second arm of the connector inserted thereto by sliding said connector in the direction in which said second arm extends, and a slot in which said engaging protrusion of the first arm is inserted, the slot having an engaging protrusion protruding inwardly for engaging said engaging protrusion of the first arm when said second arm is slidingly inserted to said arm engaging hole.

7. A fan assembly according to claim 5, wherein:

said fan unit further comprises a cantilevered beam-shaped operating lever extending in a direction opposite to a specific insertion direction, and a specific engaging member formed on the operating lever in a middle part between operating lever ends; and said fan case further comprises a removal prevention member for preventing fan unit removal by interfering with said engaging member of a fan unit housed internally to the fan case, and allowing fan unit removal by operating said operating lever to release interference with said engaging member.

8. A fan assembly according to claim 5, wherein the fan case houses a plurality of fan units mutually stacked in a direction of air flow.

9. A fan assembly according to claim 5, said fan unit further comprising a guide channel in an exterior part of a side wall, said side wall extending in said direction of air flow and said insertion direction, and heaving two edges extending in said insertion direction, and said guide channel having a first channel part extending from one said side wall edge into a middle toward said other side wall edge, and a second channel part extending to the back in said insertion direction from said end of the first channel part; and said fan case further comprising on an inside wall a guide protrusion for fitting into said guide channel;

wherein the fan unit is installed to the fan case by sliding the fan unit along the first channel part and then sliding the fan unit along the second channel part with the guide protrusion fit into the guide channel.

10. A fan assembly according to claim 5, said fan unit further comprising a guide channel in an exterior part of a side wall, said side wall extending in said direction of air flow and said insertion direction, and having two edges extending in said insertion direction, and said guide channel having a first channel part extending from one said side wall edge into a middle toward said other side wall edge, and a second channel part extending to the back in said insertion direction from said end of the first channel part; and said fan case houses a plurality of fan units with at least two arranged in the insertion direction, is freely removably inserted in said insertion direction to a specific apparatus, and comprises a first section in the back in said insertion direction for holding a fan unit, and a second section in the front in said insertion direction for holding a fan unit, said second section having on an inside wall a guide protrusion for fitting into said guide channel;

wherein a fan unit is installed to said first section by sliding in said insertion direction, and a fan unit is installed to said second section by sliding said fan unit along said first channel part and then sliding said fan unit along said second channel part with said guide protrusion fit into said guide channel.

11. An apparatus comprising a fan assembly, the fan assembly having:

a fan case for housing a fan unit, said fan unit comprising a fan having a frame and a fan blade freely rotatable to said frame;

a printed circuit board having on one end a card edge for connecting by insertion to a connector, and having mounted thereon a control circuit for controlling fan blade rotation; and a fan housing having side walls for internally housing said fan therein, internally housing said printed circuit board with said card edge projecting externally to the front in a specific insertion direction intersecting a direction of air flow of air moved by said fan, and having a ventilation opening on both walls in said direction of air flow; and a connector freely removably fixed to the fan case, the connector being connected with the card edge of the printed circuit board projecting forward in the insertion direction by an operation installing the fan unit to the fan case.

12. An apparatus according to claim 11, wherein:

the connector of the fan assembly has a body with an opening for inserting said card edge of the printed circuit board, first and second arms projecting to both sides from said body, and an engaging protrusion formed on said first arm; and the fan case of the fan assembly has an arm engaging hole for holding said second arm of the connector inserted thereto by sliding said connector in the direction in which said second arm extends, and a slot in which said engaging protrusion of the first arm is inserted, the slot having an engaging protrusion protruding inwardly for engaging said engaging protrusion of the first arm when said second arm is slidingly inserted to said arm engaging hole.

13. An apparatus according to claim 11, wherein:

the fan unit of the fan assembly further comprises a cantilevered beam-shaped operating lever extending in a direction opposite to a specific insertion direction, and a specific engaging member formed on the operating lever in a middle part between operating lever ends; and the fan case of the fan assembly further comprises a removal prevention member for preventing fan unit removal by interfering with said engaging member of a fan unit housed internally to the fan case, and allowing fan unit removal by operating said operating lever to release interference with said engaging member.

14. An apparatus according to claim 11, wherein:

the fan case of-the fan assembly houses a plurality of fan units mutually stacked in a direction of air flow through the fan units.

15. An apparatus according to claim 11, in which:

the fan unit further comprises a guide channel in an exterior part of a side wall, said side wall extending in said direction of air flow and said insertion direction, and having two edges extending in said insertion direction, and said guide channel having a first channel part extending from one said side wall edge into a middle toward said other side wall edge, and a second channel part extending to the back in said insertion direction from said end of the first channel part; and the fan case further comprises on an inside wall a guide protrusion for fitting into said guide channel;

wherein the fan unit is installed to the fan case by sliding the fan unit along the first channel part and then sliding the fan unit along the second channel part with the guide protrusion fit into the guide channel.

16. An apparatus according to claim 11, in which:

the fan unit further comprises a guide channel in an exterior part of a side wall, said side wall extending in said direction of air flow and said insertion direction, and having two edges extending in said insertion direction, and said guide channel having a first channel part extending from one said side wall edge into a middle toward said other side wall edge, and a second channel part extending to the back in said insertion direction from said end of the first channel part; and the fan case houses a plurality of fan units with at least two arranged in the insertion direction, is freely removably insertable in the same insertion direction to the apparatus, and has a first section in the back in said insertion direction for holding a fan unit, and a second section in the front in said insertion direction for holding a fan unit, said second section having on an inside wall a guide protrusion for fitting into said guide channel;

wherein a fan unit is installed to said first section by sliding in the insertion direction, and a fan unit is installed to said second section by sliding the fan unit along the first channel part and then sliding the fan unit along the second channel part with the guide protrusion fit into the guide channel.

* * * * *